US012798840B2

(12) United States Patent
Davies et al.

(10) Patent No.: US 12,798,840 B2
(45) Date of Patent: Nov. 17, 2026

(54) DRINK CONTAINER LID ASSEMBLY

(71) Applicant: CAMELBAK PRODUCTS, LLC, Petaluma, CA (US)

(72) Inventors: Jeff Davies, Petaluma, CA (US); Dean Clewis, Petaluma, CA (US)

(73) Assignee: CamelBak Products, LLC, Petaluma, CA (US)

( * ) Notice: Subject to any disclaimer, the term of this patent is extended or adjusted under 35 U.S.C. 154(b) by 9 days.

(21) Appl. No.: 19/028,496

(22) Filed: Jan. 17, 2025

(65) Prior Publication Data

US 2025/0236444 A1 Jul. 24, 2025

Related U.S. Application Data

(60) Provisional application No. 63/622,776, filed on Jan. 19, 2024.

(51) Int. Cl.

| | |
|---|---|
| ***B65D 47/28*** | (2006.01) |
| ***A47G 19/22*** | (2006.01) |
| ***B65D 25/24*** | (2006.01) |
| ***B65D 43/02*** | (2006.01) |
| ***B65D 47/32*** | (2006.01) |
| ***B65D 51/16*** | (2006.01) |
| ***B65D 53/02*** | (2006.01) |

(52) U.S. Cl.

CPC ..... *B65D 47/286* (2013.01); *A47G 19/2272* (2013.01); *B65D 25/24* (2013.01); *B65D 43/0229* (2013.01); *B65D 47/32* (2013.01); *B65D 51/1688* (2013.01); *B65D 53/02* (2013.01); *B65D 2205/00* (2013.01); *B65D 2543/00046* (2013.01); *B65D 2543/00092* (2013.01); *B65D 2543/0049* (2013.01); *B65D 2543/00564* (2013.01); *B65D 2543/00972* (2013.01)

(58) Field of Classification Search

CPC .. B65D 47/286; B65D 43/0229; B65D 47/32; B65D 2543/00046; B65D 2543/00564; B65D 51/1688; A47G 19/2272

USPC ..... 220/202, 812

See application file for complete search history.

(56) References Cited

U.S. PATENT DOCUMENTS

| | | | | |
|---|---|---|---|---|
| 2020/0055645 | A1* | 2/2020 | Lane | A47G 19/2272 |
| 2020/0231345 | A1* | 7/2020 | Lane | B65D 47/248 |
| 2022/0112011 | A1* | 4/2022 | McNamara | B65D 51/18 |
| 2024/0101319 | A1* | 3/2024 | Jinkins | B65D 47/32 |
| 2024/0262581 | A1* | 8/2024 | Lane | B65D 43/0229 |
| 2025/0229958 | A1* | 7/2025 | Taylor | A47G 19/2272 |

OTHER PUBLICATIONS

Retrieved from https://www.yeti.com/drinkware/drinkware-accessories/rambler-stronghold-lid.html; 6 pgs.

(Continued)

*Primary Examiner* — Rafael A Ortiz

(57) ABSTRACT

A lid assembly for a drink container is provided. The lid assembly can include a lid and a slider. The lid can include an opening through which a liquid is selectively dispensed. The slider can selectively reveal the opening by sliding along the lid. The slider can include a first slider portion that can slide along a first surface of the lid and a second slider portion that can slide along a second surface of the lid.

10 Claims, 24 Drawing Sheets

(56) References Cited

OTHER PUBLICATIONS

Retrieved from https://www.camelbak.com/shop/drinkware/tumblers/horizon-12-oz-tumbler-insulated-stainless-steel/CB-2387.html?srsltid=AfmBOopyX7KsJcs3LelnAKLhGnKCySbt7uhXoxJCET84BmBtY0eL8gCz; 6 pgs.
Brumate Imperial Pint Muv V2 20 oz: https://www.youtube.com/watch?v=CzjkHTbaGIM.
Retrieved from Zak! Designs Latah Tumbler Contour Lid 20 oz: https://www.amazon.co.uk/Zak-Designs-Stainless-Tumbler-Contour/dp/B0C2B7J9LN; 4 pgs.

* cited by examiner

DRINK CONTAINER LID ASSEMBLY

RELATED APPLICATION DATA

This application claims priority to U.S. Provisional Application No. 63/622,776, filed Jan. 19, 2024, the disclosure of which is hereby incorporated by reference in its entirety.

FIELD

The present invention relates to lid assemblies for drink containers, and particularly lid assemblies for leak prevention and venting and drink containers including the same.

BACKGROUND

Drink containers are useful for storing and transporting consumable liquids, or beverages. Some drink containers can receive one or more types of lids that removably secure to a sidewall or opening of containers. Lids can function to close containers to facilitate storage and transportation. In addition, the lid can be suitable for releasing beverages. For example, the lid can include a drink opening that can fluidly couple ambient with the interior of the drink container to release the contained beverage for consumption. A closure on the lid can be movable to selectively close and reveal the drink opening. The closure can be formed on the top of the lid such that a user action can be received to move the closure. Drink containers can also include mechanisms to maintain a temperature of the contained beverage. Allowing for temperature control in a lid and beverage consumption can be challenging to configure. Thus, a need exists for drink containers with improved lids.

SUMMARY

A lid assembly for a drink container is provided. The lid assembly can include a lid comprising an opening through which a liquid is selectively dispensed, the opening positioned at a first end of the lid. The lid assembly can also include a first slider track along a first surface of the lid, the first slider track comprising a projection configured to extend from a first half of the lid including the first end to a second half end of the lid opposite the first half, the projection comprising a continuous width through its length and height. The lid assembly can also include a slider configured to selectively reveal the opening. The slider can include a first top slider portion configured to couple to the projection to slide along the first slider track, the first slider portion comprising a receiving portion; and a second bottom slider portion comprising a projecting portion configured to removably couple to the receiving portion.

The lid can include a slider opening, the projecting portion configured to extend through the slider opening to couple to the receiving portion.

The projecting portion can be received by the receiving portion in an assembled configuration. The projecting portion can include a rib configured to be retained via a snap fit by the receiving portion in the assembled configuration. The second bottom slider portion can include a tab opposing the projecting portion, the tab configured to release the slider from the assembled configuration.

The lid can include a second slider track extending along a second surface of the lid opposing the first surface from the first end of the lid to the second end of the lid. The second slider track can include an upper receiving detent configured to receive the second bottom slider portion in a first position in which the opening is closed and a second position in which the opening at least partially is revealed. The second slider track can include a second pair of lower receiving detents extending from the upper receiving detent, the second pair of lower receiving detents configured to receive a second pair of projecting tabs of the second bottom slider portion in the third position in which the opening is fully revealed and the slider is movable between the assembled configuration and the disassembled configuration. The upper receiving detent can be bounded by an upper rib and a lower rib opposing the upper rib to form the second slider track, the first pair of lower receiving detents extending through the lower rib such that the slider is movable between the assembled configuration and the disassembled configuration.

A lid assembly for a drink container is provided. The lid assembly can include a lid. The lid can include an opening through which a liquid is selectively dispensed, the opening extending through a first surface of the lid to a second surface of the lid opposing the first surface. The lid can also include a first slider track along the first surface of the lid, the first slider track comprising at least one projection, and a second slider track along the second surface of the lid, the second slider track comprising at least one receiving detent. The lid assembly can also include a slider configured to slide along the first slider track and the second slider track to selectively reveal the opening. The slider can include at least one retention portion configured to receive the at least one projection, and at least one projecting tab, the at least one receiving detent configured to receive the at least one projecting tab.

The slider can include a first slider portion and a second slider portion, the first slider portion comprising the retention portion, and the second slider portion comprising the at least one projecting tab. The second slider portion can be removable from the first slider portion when the opening is fully revealed.

The opening can be positioned at a first end of the lid. The slider can move from the first end to a second end of the lid opposing the first end to selectively reveal the opening.

The lid assembly can also include a gasket disposed between the lid and the slider along the second surface of the lid. The gasket can be sealed against the second surface along the first end of the lid as the slider moves from the first end to the second end to prevent venting. The gasket can be released from the second surface along the second end of the lid when the slider is at the second end to facilitate venting. The lid can include a gap portion such that a venting space is formed between the lid and the gasket when the slider is at the second end.

A drink container is provided that includes: a liquid container including a base; a lid including a first end and a second end opposing the first end, and an opening positioned at the first end; a base configured to be received by the liquid container, a through opening extending from the opening to the base; a slider configured to selectively reveal the opening and move from the first end of the lid in which the opening is closed to the second end of the lid in which the opening is fully revealed; and a gasket disposed between the slider and the lid, the gasket configured to seal against the lid at the first end and release the lid at the second end as the slider moves from the first end to the second end.

The lid can include a lower surface configured to contact the gasket and an intermediate surface, the intermediate surface being above the lower surface at the second end of the lid such that a gap forms between the intermediate surface and the gasket to release the gasket from the lid at the second end.

The base can include a damper having a grid structure configured to cushion the liquid container.

The liquid container can include a chamfer around a circumference of the liquid container configured to provide a grip surface.

BRIEF DESCRIPTION OF THE DRAWINGS

The disclosed aspects will hereinafter be described in conjunction with the appended drawings, provided to illustrate and not to limit the disclosed aspects, wherein like designations denote like elements.

DETAILED DESCRIPTION

Figure 1:
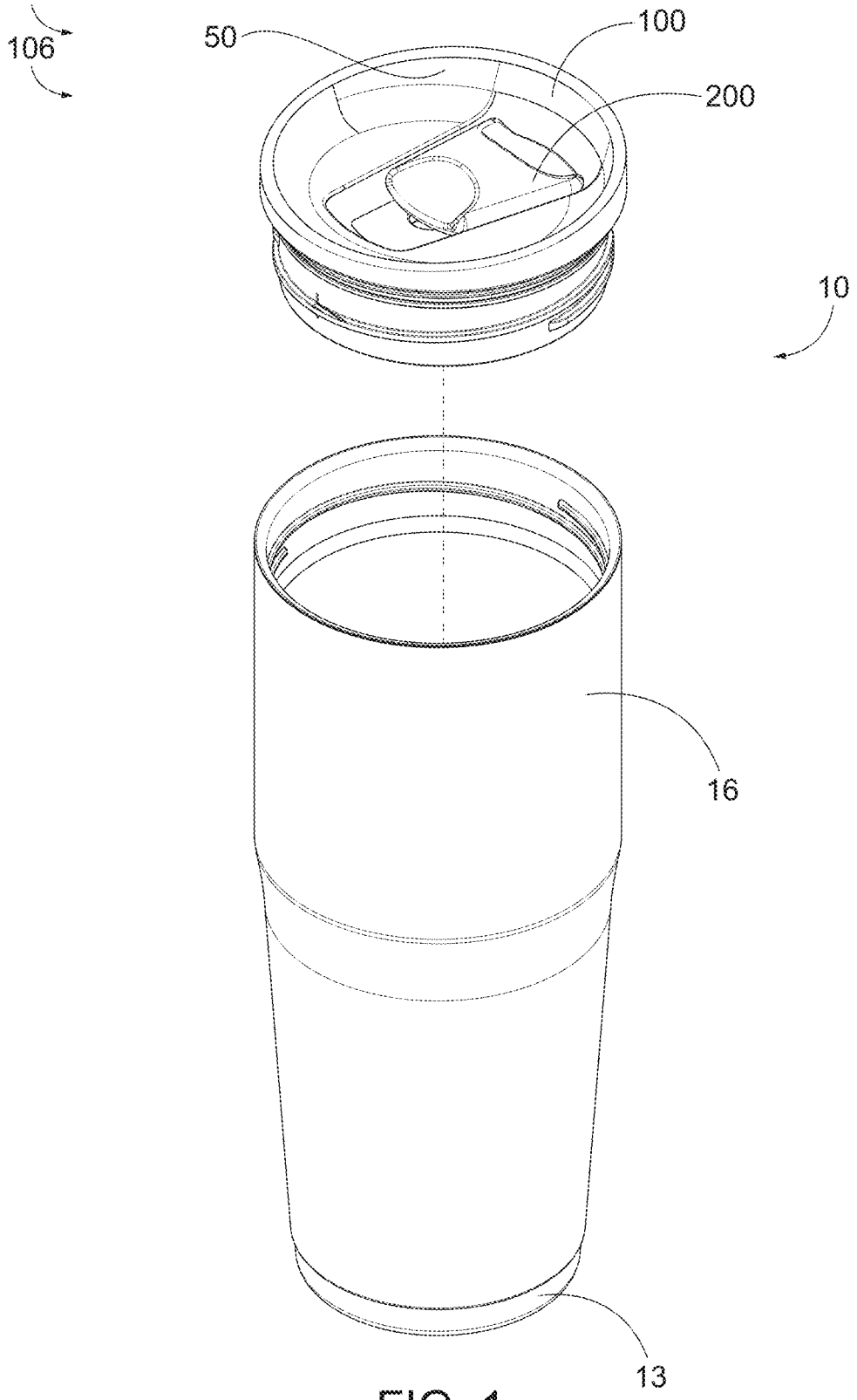
FIG. 1 shows an assembly view of a drink container according to an exemplary embodiment.

Various aspects of the novel systems, apparatuses, and methods disclosed herein are described more fully hereinafter with reference to the accompanying drawings. This disclosure can, however, be embodied in many different forms and should not be construed as limited to any specific structure or function presented throughout this disclosure. Rather, these aspects are provided so that this disclosure will be thorough and will fully convey the scope of the disclosure to those skilled in the art. Based on the teachings herein, one skilled in the art would appreciate that the scope of the disclosure can be intended to cover any aspect of the novel systems, apparatuses, and methods disclosed herein, whether implemented independently of, or combined with, any other aspect of the disclosure. For example, an apparatus can be implemented or a method can be practiced using any number or combination of the aspects set forth herein. In addition, the scope of the disclosure can be intended to cover such an apparatus or method that can be practiced using other structure, functionality, or structure and functionality in addition to or other than the exemplary embodiments of the disclosure set forth herein. It should be understood that any embodiment disclosed herein can be implemented by one or more elements of a claim.

Although exemplary embodiments are described herein, many variations and permutations of these exemplary embodiments fall within the scope of the disclosure. Although some benefits and advantages of the exemplary embodiments are mentioned, the scope of the disclosure can be not intended to be limited to particular benefits, uses, and/or objectives. The detailed description and drawings are merely illustrative of the disclosure rather than limiting, the scope of the disclosure being defined by the appended claims and equivalents thereof.

It will be recognized that while exemplary embodiments of the disclosure are described in terms of a specific sequence of steps of a method, these descriptions are only illustrative of the broader methods of the disclosure, and can be modified as required by the particular application. Certain steps can be rendered unnecessary or optional under certain circumstances. Additionally, certain steps or functionality can be added to the exemplary embodiments, or the order of performance of two or more steps permuted. All such variations are considered to be encompassed within the disclosure disclosed and claimed herein.

While the disclosure has been illustrated and described in detail in the drawings and foregoing description, such illustration and description are to be considered illustrative or exemplary and not restrictive. The disclosure is not limited to the exemplary embodiments. Variations to the exemplary embodiments and/or implementations can be understood and effected by those skilled in the art in practicing the claimed disclosure, from a study of the drawings, the disclosure and the appended claims.

Drink containers with lids can be used to store and transport beverages, and to facilitate beverage consumption. Some containers are configured to hold both cold and hot beverages. These containers can include reservoirs to hold beverages and sidewall structures that provide insulation to limit or prevent heating or cooling. The sidewall structure of a container can also receive one or more types of lids. Lids can have several functions, including to close containers to limit or prevent leakage during use of the containers.

Some lids can have drink openings configured as through openings to fluidly couple ambient with the interior of the container. Accordingly, drink openings can allow users to consume beverages stored in containers. These lids can include closure mechanisms that are user actuated to selectively close and reveal drink openings. In this way, a user can reveal a drink opening to consume a beverage and close the drink opening after consumption. Users may wish to close drink openings to limit or prevent leakage and to maintain insulation. However, some lids that can be opened via closure mechanisms and drink openings might not sufficiently limit or prevent leakage.

Drink openings can have additional functions. For example, drink openings can be sized to receive drink accessories, such as straws, that support beverage consumption. Drink openings can also facilitate venting. Accordingly, steam from hot beverages can be released through drink openings. Venting through the drink opening can be unpleasant though and negatively affect the user experience. Instead of releasing steam from the same opening from which the user drinks, it can be desirable to have a separate venting opening.

Lids can include one or more movable components to facilitate closure, limiting or preventing leakage, and venting. Some lids with multiple components, some of which may be movable, can be difficult to clean. Accordingly, it can be desirable for lids to be disassembled to clean, or to replace, parts. However, disassembly and then reassembly of parts can be difficult.

Systems and methods described herein provide a drink container lid assembly that addresses the problems discussed herein. The lid assembly can include a lid having a drink opening through which a beverage can be dispensed. A slider of the lid assembly can alternately reveal and close the drink opening. The slider can include two portions to facilitate closure, the portions slidable along opposing sides of the lid. A gasket positioned between the two portions along one side of the lid can provide a seal to limit or prevent leakage. As the slider slides along the lid to reveal the drink opening, a gap between the slider and the lid can form away from the drink opening for venting. The lid assembly can be disassembled for cleaning or to replace parts, and easily reassembled for use.

Systems and methods will now be described with reference to the figures. FIG. 1 illustrates a drink container 10, according to an exemplary embodiment. As shown, drink container 10 can include a lid assembly 50 and a liquid container 16. An assembly view is shown in FIG. 1 with lid assembly 50 separated from liquid container 16. Lid assembly 50 can be received by liquid container 16, such as by a sidewall of liquid container 16 for assembly. Liquid container 16 and lid assembly 50 can include threading, for example, to facilitate coupling of liquid container 16 and lid assembly 50. Liquid container 16 can include an internal reservoir to hold hot or cold beverages, e.g., water, tea, coffee, or soft drinks.

Figure 4:
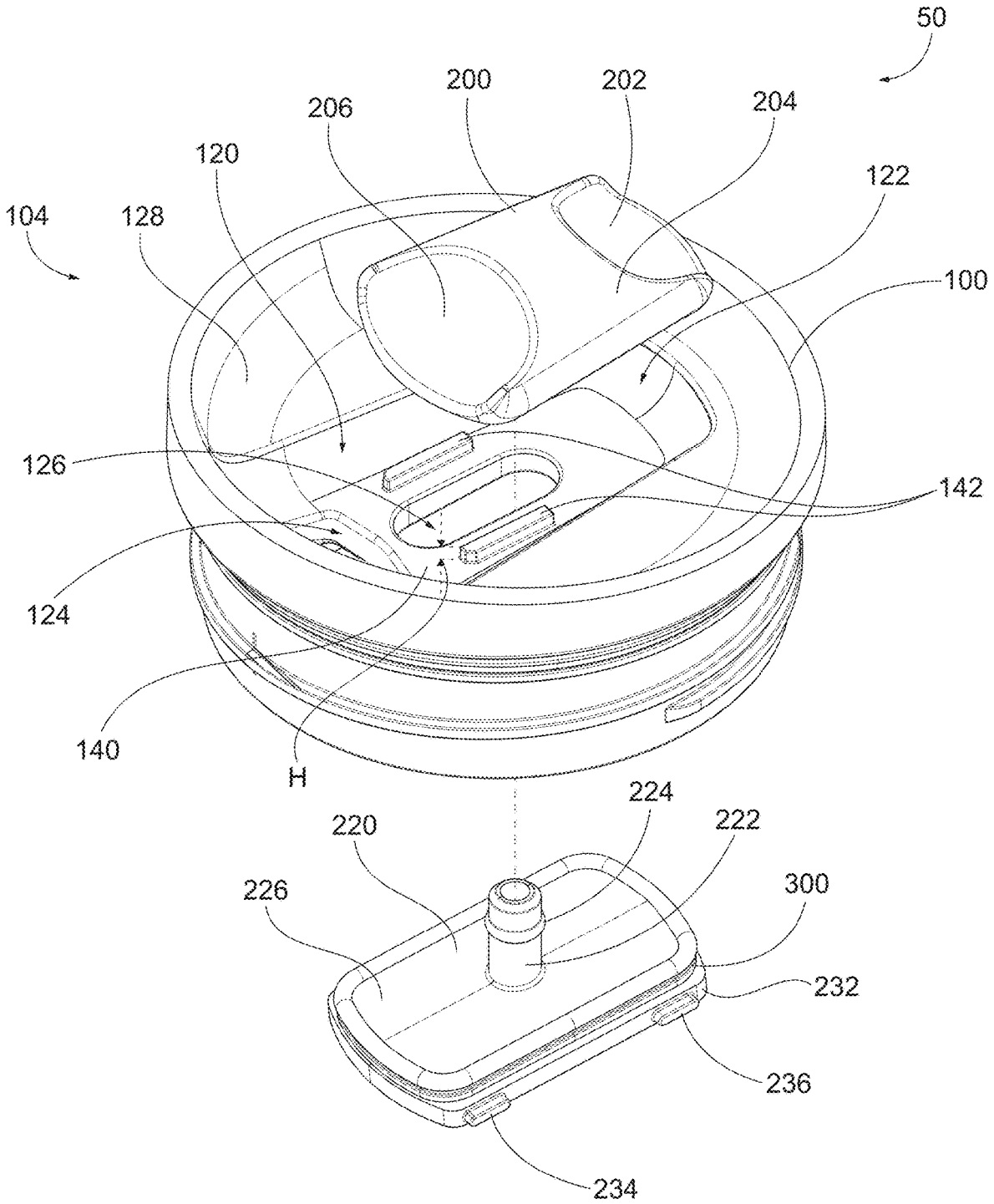
FIG. 4 shows an assembly view of the lid assembly of FIG. 2.

Lid assembly 50 can include a lid 100 and a slider 200. Slider 200 can be disassembled from lid assembly 50 to clean lid 100 or slider 200, or for replacement of parts, for example. Lid 100 and slider 200 are shown coupled together in FIG. 1 such that lid assembly 50 is in assembled configuration 102. Also as shown in FIG. 1, lid assembly 50 can be in a closed position 106, in which slider 200 closes one or more openings, such as a drink opening 124 (FIG. 4). Lid 100 can facilitate fluidly coupling the internal reservoir of liquid container 16 with ambient via the one or more openings to allow users to consume a beverage held in drink container 10. Lid 100 also can close liquid container 16 to prevent a user from consuming a beverage held in liquid container 16 or to limit or prevent leakage during use of drink container 10. Slider 200 can move along lid 100 to alternately reveal and close the one or more openings.

Figure 2:
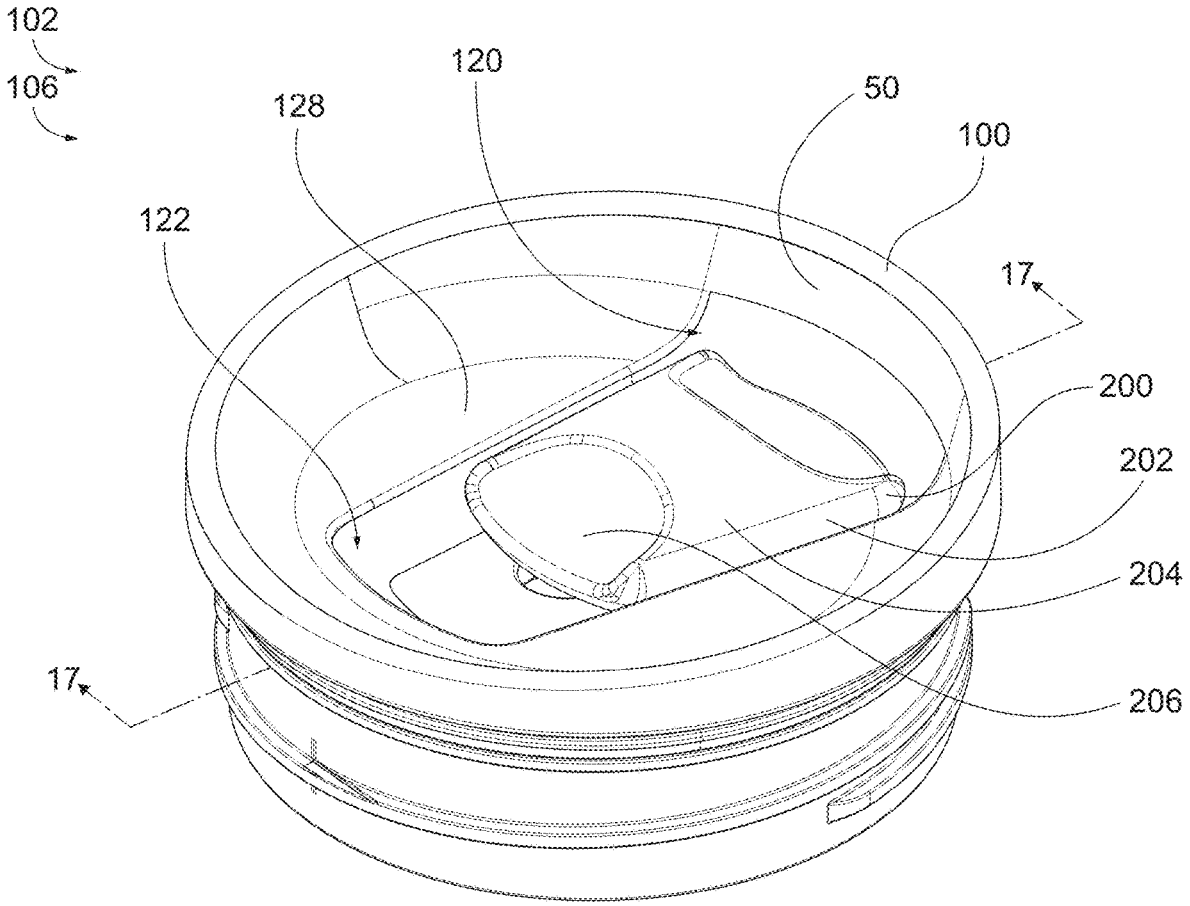
FIG. 2 shows a top perspective view of a lid assembly of the drink container of FIG. 1.

Lid assembly 50 is shown in FIG. 2, according to an exemplary embodiment. Lid assembly 50 is in assembled configuration 102 and closed position 106. In other words, lid 100 and slider 200 are coupled, and slider 200 has closed one or more openings, such as drink opening 124 (FIG. 4). Lid 100 can include a first end 120 and a second end 122 opposing first end 120. First end 120 can generally refer to a first half of lid 100 taken from a central axis A (FIG. 14) of lid 100. Second end 122 can generally refer to a second half of lid 100 opposing the first half taken from central axis A. In closed position 106, slider 200 can be positioned at first end 120. Slider 200 can selectively reveal one or more openings and move from first end 120 to second end 122 in which the one or more openings is fully revealed.

Lid 100 can also include a first surface 128, which can be a top surface facing the ambient environment. Slider 200 can include one or more portions that slide along first surface 128. As shown, a first, or top, slider portion 202 can slide along first surface 128. First slider portion 202 can include a top side 204. Top side 204 can face the ambient environment. As top side 204 faces the ambient environment, top side 204 can be accessible by a user. Top side 204 can include a user grip 206 that can be actuated by a user to move slider 200. Moving slider 200 can alternately reveal and close one or more openings of lid 100, such as drink opening 124 (FIG. 4). As shown, user grip 206 can include one or more grooves that can receive one or more fingers of a user to move slider 200.

Figure 3:
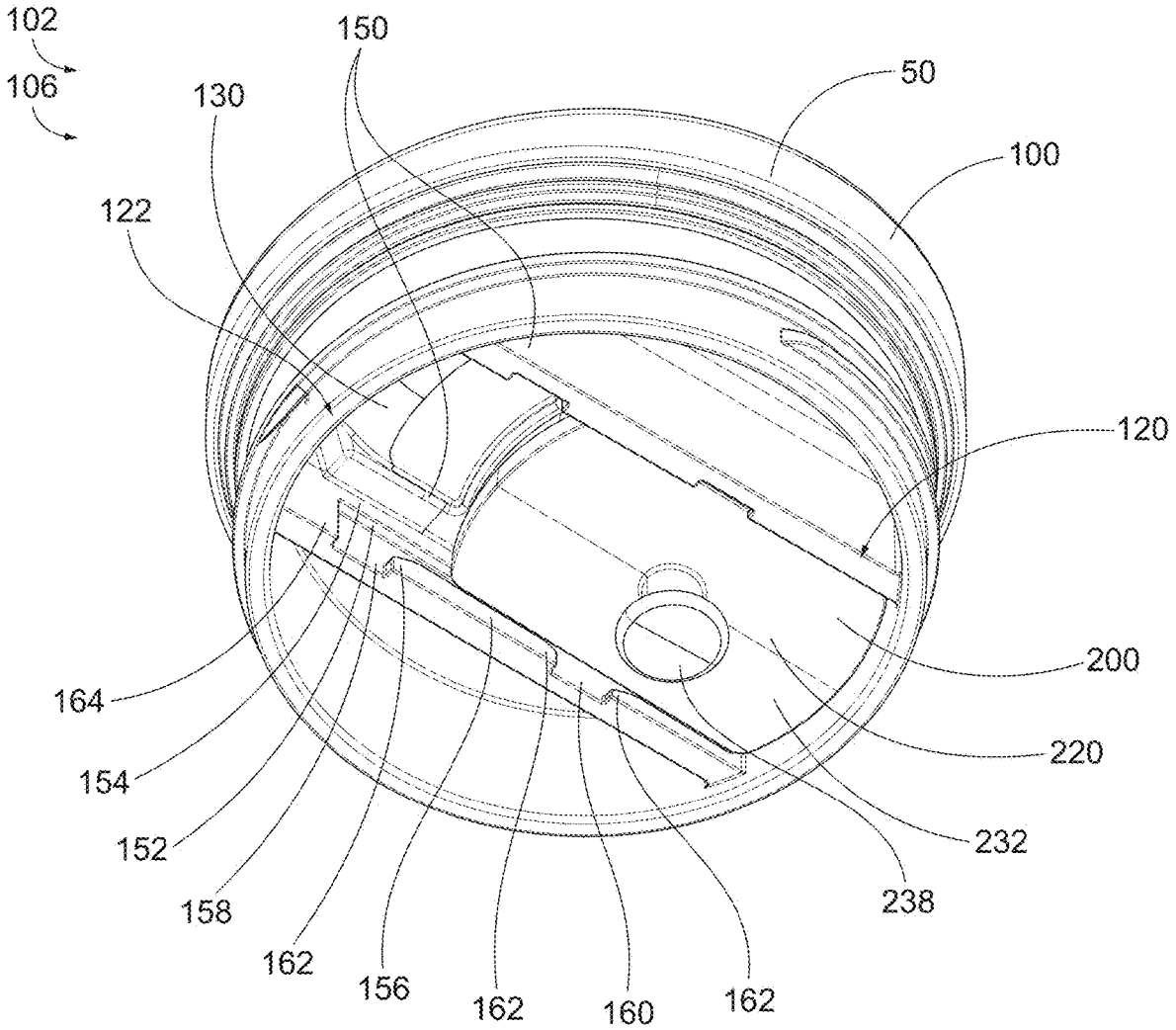
FIG. 3 shows a bottom perspective view of the lid assembly of the of FIG. 2.

Opposing first surface 128 can be a second surface 130, which can be a bottom surface facing the internal reservoir of liquid container 16 (FIG. 1), as shown in FIG. 3, according to an exemplary embodiment. Slider 200 can include one or more portions that slide along second surface 130. As shown, a second, or bottom, slider portion 220 can slide along second surface 130, such as along a second slider track 150. Second slider track 150 can include one or more upper receiving detents 152, each upper receiving detent 152 bounded by an upper rib 154 and a lower rib 156. The second slider portion 220 can be received in one or more upper receiving detents 152 and retained by upper rib 154 and lower rib 156 of each upper receiving detent 152 in assembled configuration 102 and closed position 106. As shown, second slider track 150 can include two, opposing upper receiving detents 152. Lower ribs 156 of the two upper receiving detents 152 can include a first pair of lower receiving detents 158 and a second pair of lower receiving detents 160. Second slider portion 220 can be released from lid 100 via first pair of lower receiving detents 158 and second pair of lower receiving detents 160. Each of first pair of lower receiving detents 158 and second pair of lower receiving detents 160 can include one or more ramps 162 to assist second slider portion 200 in releasing from lid 100. In other words, ramps 162 can engage second slider portion 200 such that second slider portion 200 is guided by ramps 162 to release from lid 100. Releasing second slider portion 220 can facilitate disassembly of slider 200 to clean or replace slider 200 parts, for example. Releasing second slider portion 220 will be described further below.

Referring to FIG. 3, second slider portion 220 can include a lower side 232. Lower side 232 can face the internal reservoir of liquid container 16 (FIG. 1). Lower side 232 can be accessible by a user when lid assembly 50 is removed from drink container 10 (FIG. 1). Lower side 232 can include a pull tab 238 that can be gripped by a user to release second slider portion 220 from lid 100, thereby disassembling slider 200. Gripping pull tab 238 and pulling it away from second surface 130 can cause disassembly of slider 200 to clean or replace slider 200 parts, for example.

Lid assembly 50 in a disassembled position 104 is shown in FIG. 4, according to an exemplary embodiment. As shown, lid assembly 50 can include lid 100 and slider 200, slider 200 having first slider portion 202 and second slider portion 220. Slider 200 can be assembled about lid 100. In other words, first slider portion 202 can be coupled to second slider portion 220 to form slider 200 such that lid 100 is intermediate to first slider portion 202 and second slider portion 220. Second slider portion 220 can include a projecting portion 222 that extends from an upper side 226 of slider portion 220, where upper side 226 opposes lower side 232. Projecting portion 222 can extend through a slider opening 126 in lid 100 and can have a rib 224 to facilitate coupling of second slider portion 220 to first slider portion 202. Assembly of slider 200 will be described further below.

As discussed above, lid 100 can include first end 120 and second end 122 opposing first end 120. Lid 100 can also include one or more openings. FIG. 4 shows drink opening 124. Lid 100 can include drink opening 124 through which a liquid, or a beverage held in drink container 10, is selectively dispensed. Drink opening 124 can be positioned at first end 120 of lid 100 and can extend through first surface 128 of lid 100 to second surface 130 (FIG. 3) opposing first surface 128. Slider 200 can selectively reveal drink opening 124. Slider 200 can selectively reveal drink opening 124 by moving from first end 120 to second end 122 in which drink opening 124 is fully revealed.

Drink container 10 (FIG. 1) can also include a gasket 300. With reference to FIG. 4, lid assembly 50 can include gasket 300. Gasket 300 can be assembled in lid assembly 50 such that gasket 300 is adjacent second surface 130 (FIG. 3) of lid 100. Gasket 300 can include a continuous upper surface 301 such that gasket 300 is devoid of openings at the interface between gasket 300 and second surface 130. Thus, gasket 300 is adjacent second surface 130 such that gasket 300 is intermediate to lid 100 and second slider portion 220. In this way, gasket 300 can seal against lid 100. As discussed herein, drink container 10 can facilitate venting away from openings allowing for beverage consumption, e.g., drink opening 124. Gasket 300 can seal against lid 100 at first end 120 and release lid 100 as slider 200 moves from first end 120 to second end 122.

Figure 5:
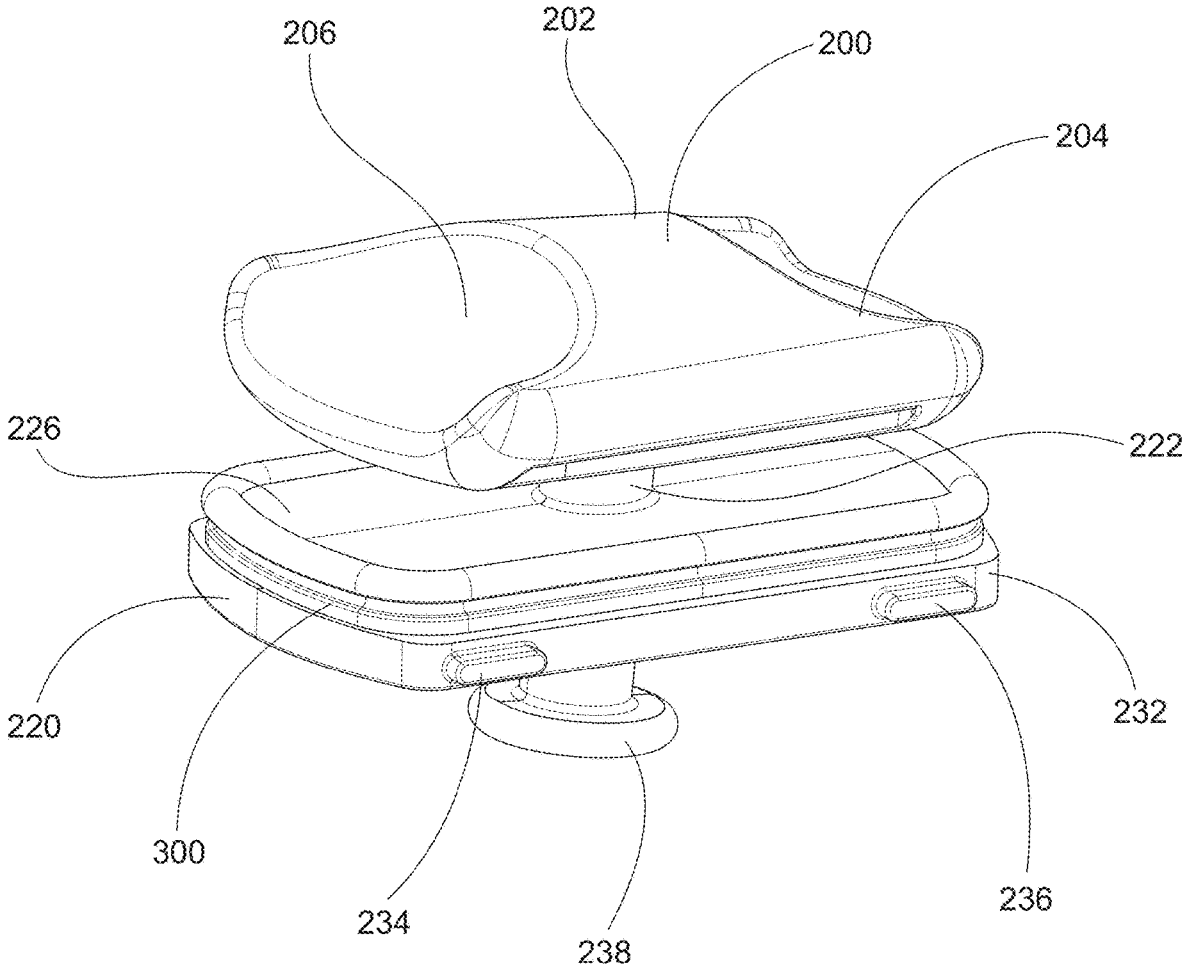
FIG. 5 shows a perspective view of a slider of the lid assembly of FIG. 2.
Figure 6:
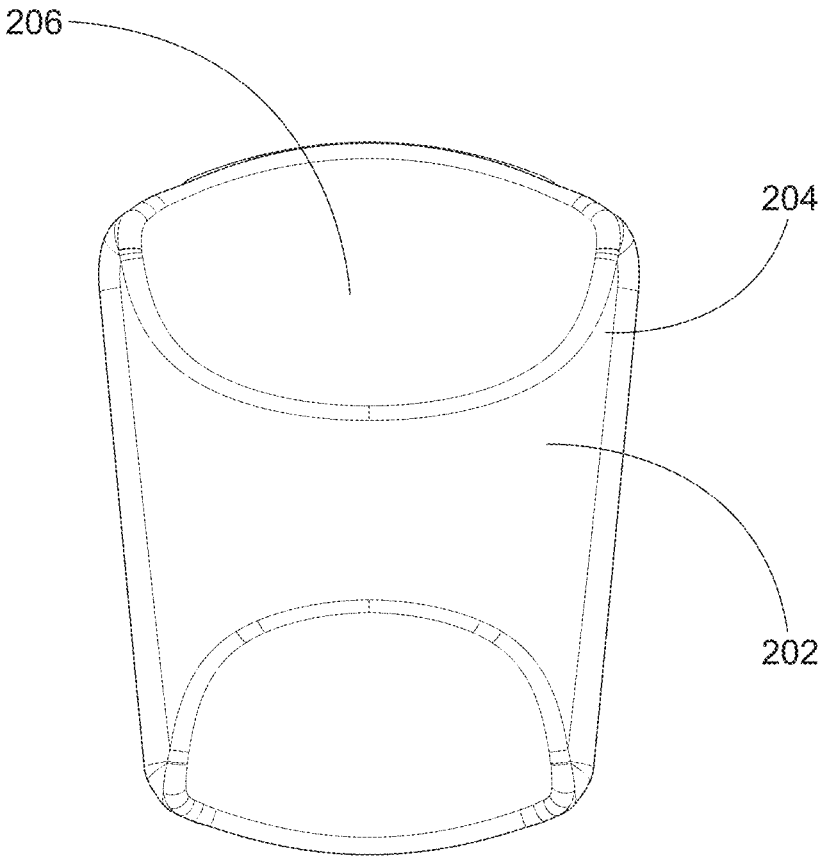
FIG. 6 shows a top view of a top portion of the slider of FIG. 5.
Figure 7:
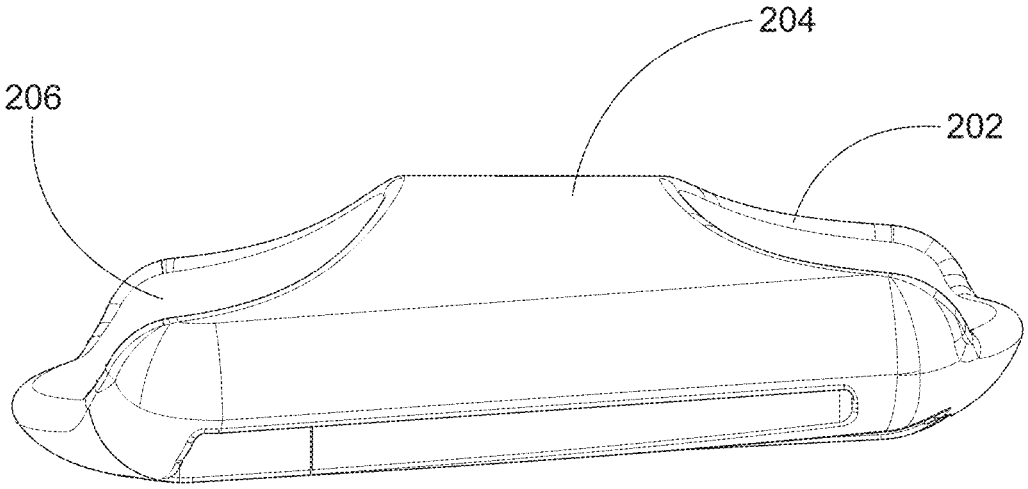
FIG. 7 shows a side view of the top portion of the slider of FIG. 6.

Slider 200 in an assembled configuration without lid 100 is shown in FIG. 5, according to an exemplary embodiment. Second slider portion 220 is coupled to first slider portion 202 such that gasket 300 is intermediate to first slider portion 202 and second slider portion 220. As shown in FIGS. 6-7, according to an exemplary embodiment, first slider portion 202 can have top side 204 and user grip 206 formed in top side 204. User grip 206 can include one or more depressions formed in top side 204. First slider portion 202, such as at top side 204, such as at user grip 206, can be gripped by a user to release first slider portion 202 from second slider portion 220, thereby disassembling slider 200.

Figure 8:
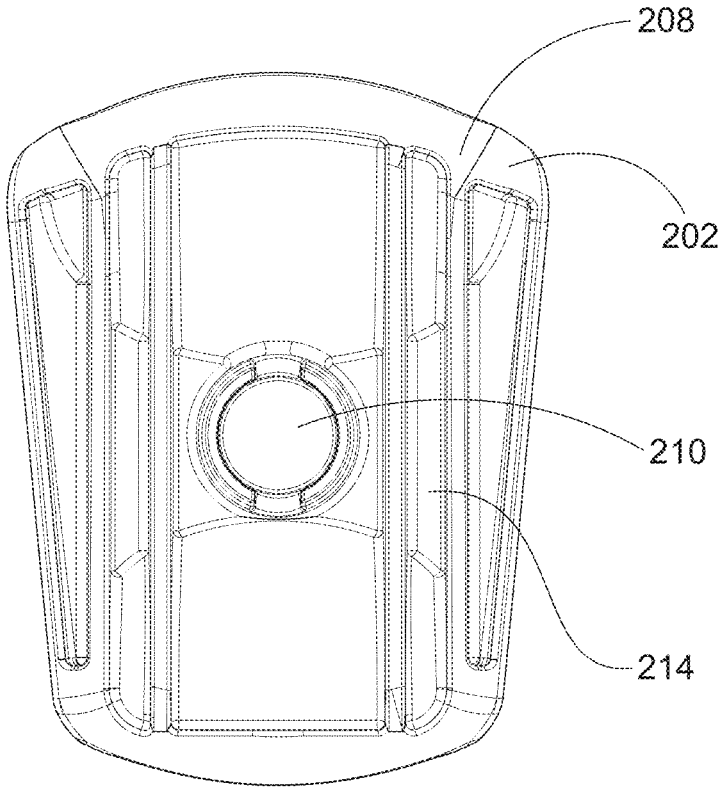
FIG. 8 shows a bottom view of the top portion of FIG. 6.
Figure 9:
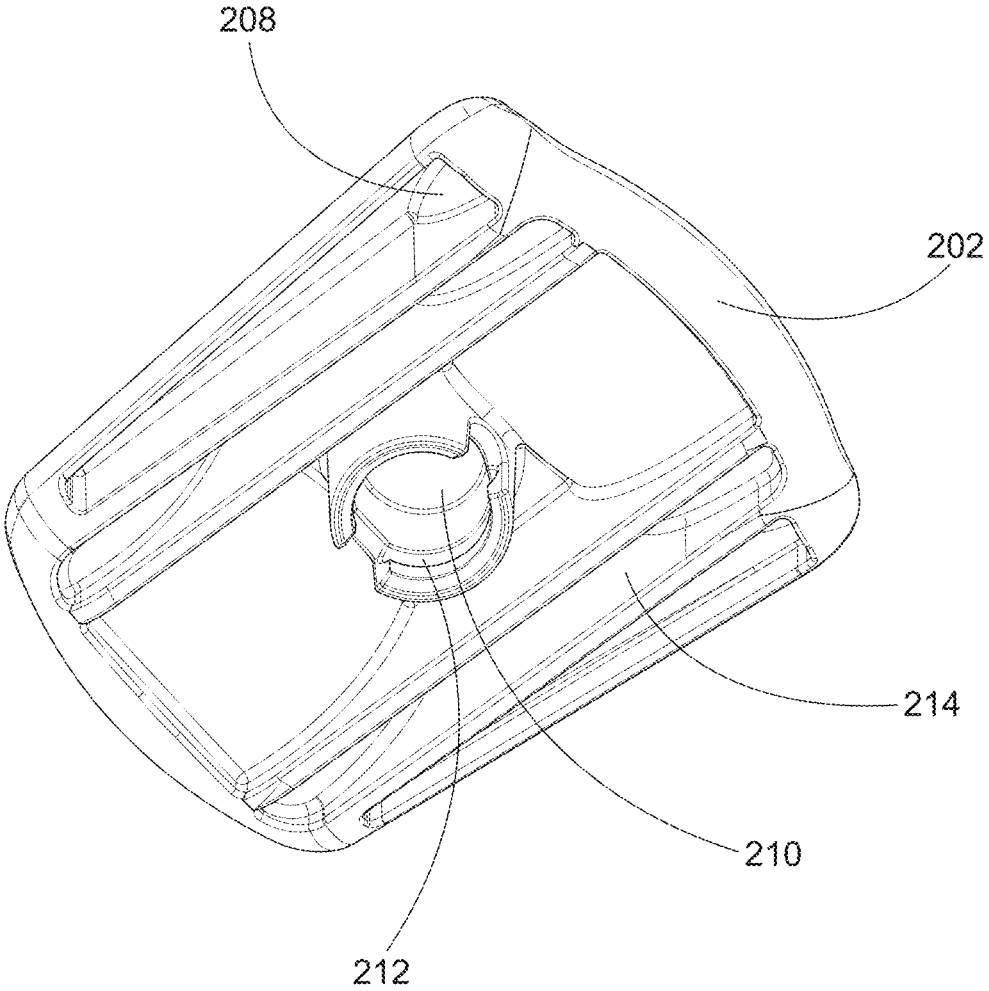
FIG. 9 shows a bottom perspective view of the top portion of FIG. 6.

First slider portion 202, shown in FIGS. 8-9, according to an exemplary embodiment, can include a bottom side 208 facing the internal reservoir of liquid container 16 (FIG. 1). Bottom side 208 can include one or more retention portions 214. One or more retention portion 214 can facilitate coupling of first slider portion 202 with lid 100 (FIG. 4), such as one or more projections 142 (FIG. 4) of lid 100. Coupling of first slider portion 202 and lid 100 will be described further below.

Bottom side 208 can also include a receiving portion 210. Receiving portion 210 can be positioned at a general center of bottom side 208. A projecting portion 222, shown in FIGS. 10-11, according to an exemplary embodiment, of second slider portion 220 can be received by receiving portion 210 in an assembled configuration of slider 200 (FIG. 5). Projecting portion 222 can removably couple to receiving portion 210. In other words, projecting portion 222 can be released from receiving portion 210 such that second slider portion 220 is removable from first slider portion 202. As receiving portion 210 can be positioned at a general center of bottom side 208, coupling of receiving portion 210 and projecting portion 222 can be at a general center of bottom side 208.

Pull tab 238 can oppose projecting portion 222, as shown with reference to FIG. 5. Pull tab 238 can release slider 200 from an assembled configuration of slider 200. Pull tab 238 can be gripped by a user to release second slider portion 220 from lid 100, thereby disassembling slider 200. Accordingly, gripping first slider portion 202, such as at top side 204, such as at user grip 206, or pull tab 238 and pulling each away from the opposing structure can cause disassembly of slider 200 to clean or replace slider 200 parts, for example.

With reference to FIGS. 8-11, projecting portion 222 can extend from upper side 226 to be received by second slider portion 220. Projecting portion 222 can include rib 224. Rib 224 can be retained by receiving portion 210 in an assembled configuration of slider 200 (FIG. 5). Rib 224 can be retained via a snap fit by receiving portion 210. Receiving portion 210 can include a groove or opening 212 that can retain rib 224. To release second slider portion 220 from first slider portion 202, the snap fit between rib 224 and receiving portion 210, such as groove or opening 212, can be overcome. As receiving portion 210 can be positioned at a general center of bottom side 208, the snap fit of rib 224 and receiving portion 210 can be at a general center of bottom side 208.

Figure 10:
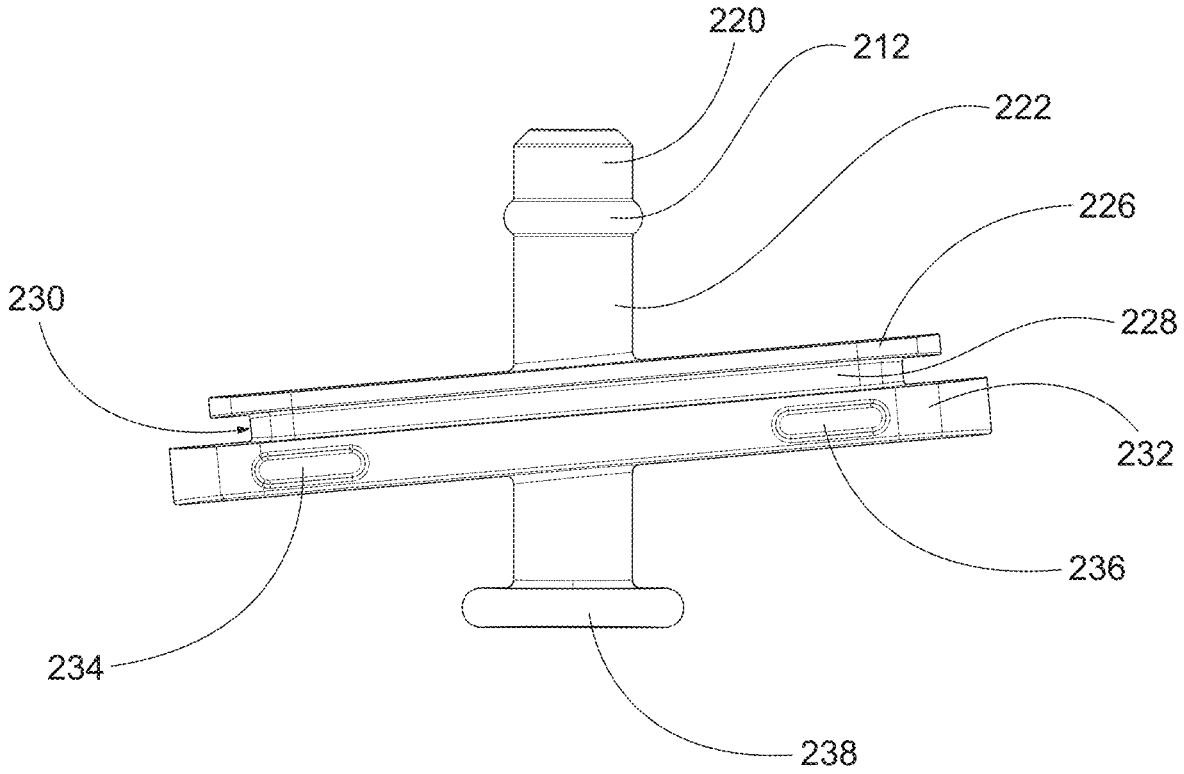
FIG. 10 shows a side view of a bottom portion of the slider of FIG. 5.
Figure 11:
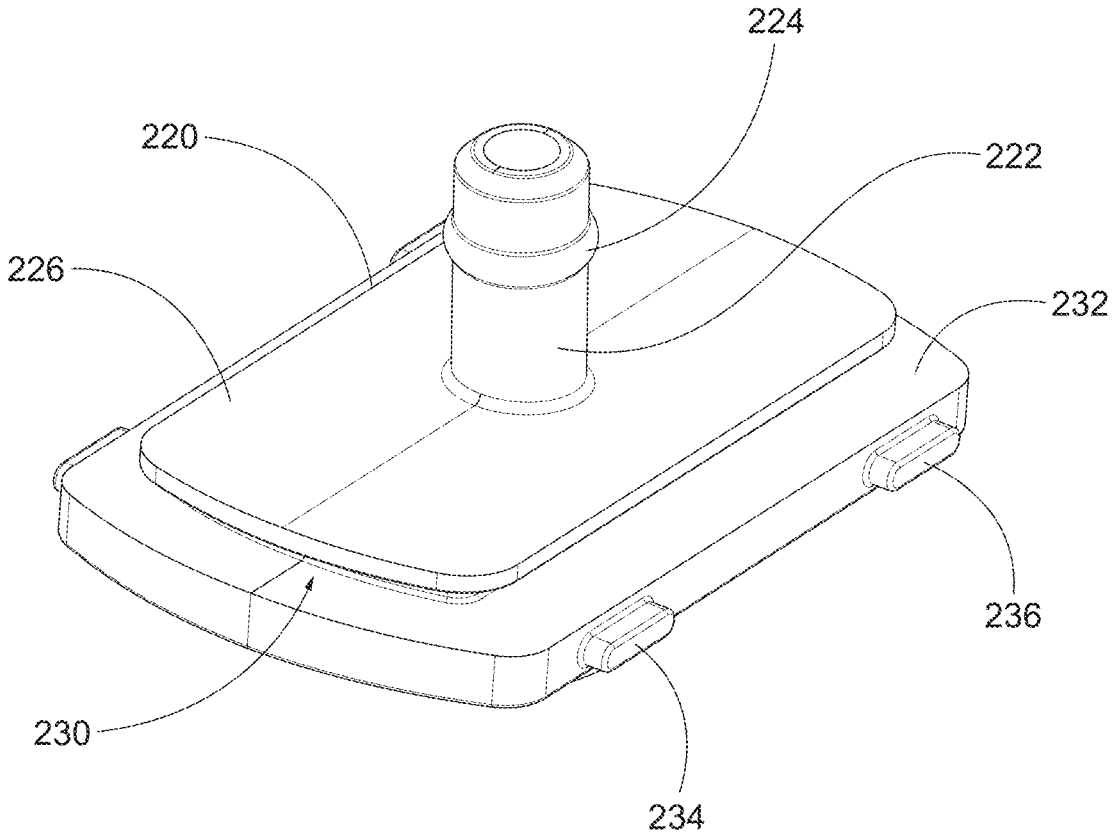
FIG. 11 shows a top perspective view of the bottom portion of FIG. 10.

Second slider portion 220 is best shown in FIGS. 10-13, according to an exemplary embodiment. As discussed, second slider portion 220 can include upper side 226 opposing lower side 232. Pull tab 238 extending from lower side 232 can oppose projecting portion 222 extending from upper side 226. Between upper side 226 and lower side 232, can be an intermediate side 228. Gasket 300 (FIG. 5) can fit within intermediate side 228. As shown in FIGS. 10-11, a gap 230 can be formed from intermediate side 228 being inset from upper side 226 and lower side 232. Gasket 300 can fit in gap 230 such that gasket 300 is secured.

Figure 12:
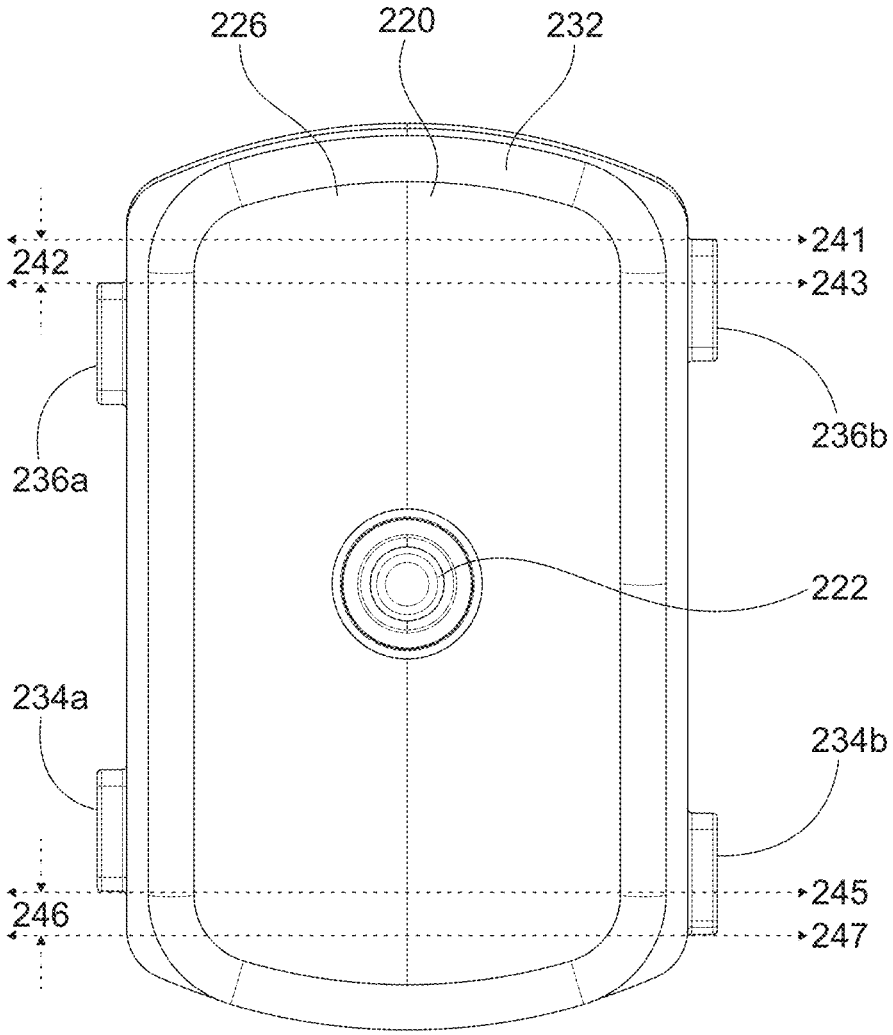
FIG. 12 shows a top view of the bottom portion of FIG. 10.
Figure 13:
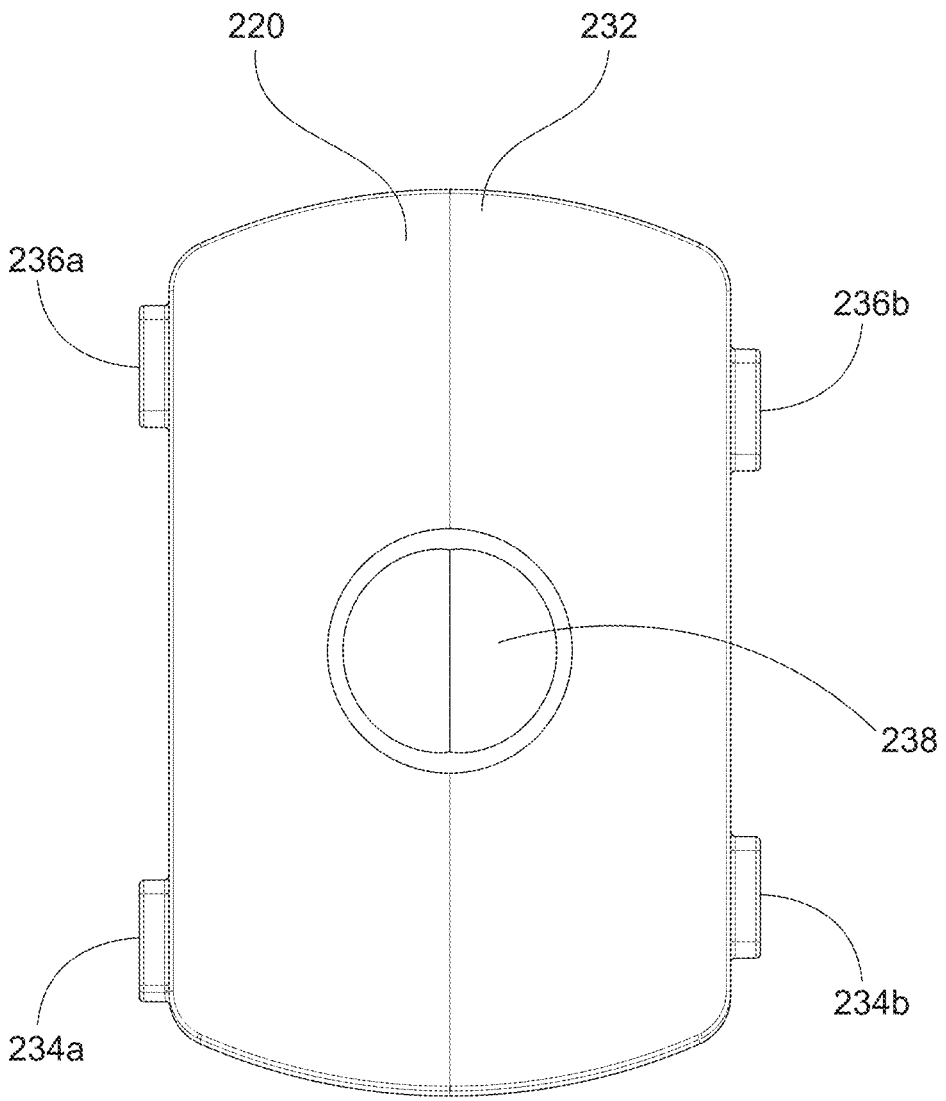
FIG. 13 shows a bottom view of the bottom portion of FIG. 10.

Second slider portion 220 can also include one or more projecting tabs, such as a first pair of projecting tabs 234 and a second pair of projecting tabs 236. With reference to FIGS. 12-13, first pair of projecting tabs 234 and second pair of projecting tabs 236 can extend outwardly from second slider portion 220, such as from lower side 232. Each projecting tab in first pair of projecting tabs 234 can extend from opposing sides of second slider portion 220. In addition, each projecting tab in first pair of projecting tabs 234 can be offset. In other words, projecting tab 234*a* of first pair of projecting tabs 234 can extend along an axis 245. Projecting tab 234*b* of first pair of projecting tabs 234 can extend along an axis 247. Axis 245 and axis 247 can be at a distance 246 from one another. Similarly, each projecting tab in second pair of projecting tabs 236 can extend from opposing sides of second slider portion 220. In addition, each projecting tab in second pair of projecting tabs 236 can be offset. In other words, projecting tab 236*a* of second pair of projecting tabs 236 can extend along an axis 243. Projecting tab 236*b* of second pair of projecting tabs 236 can extend along an axis 241. Axis 241 and axis 243 can be at a distance 242 from one another.

Figure 14:
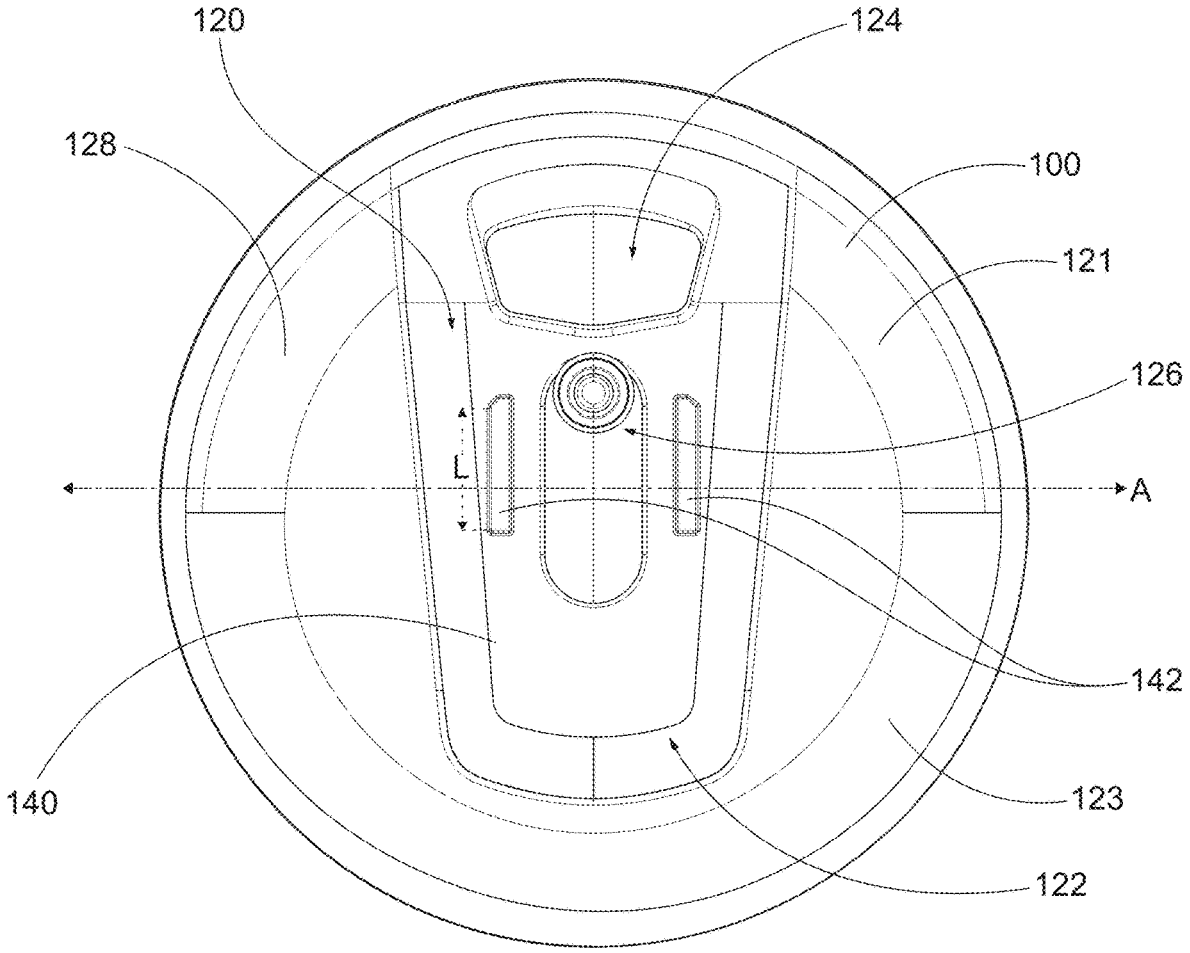
FIG. 14 shows a top view of a lid of the lid assembly of FIG. 2.
Figure 15:
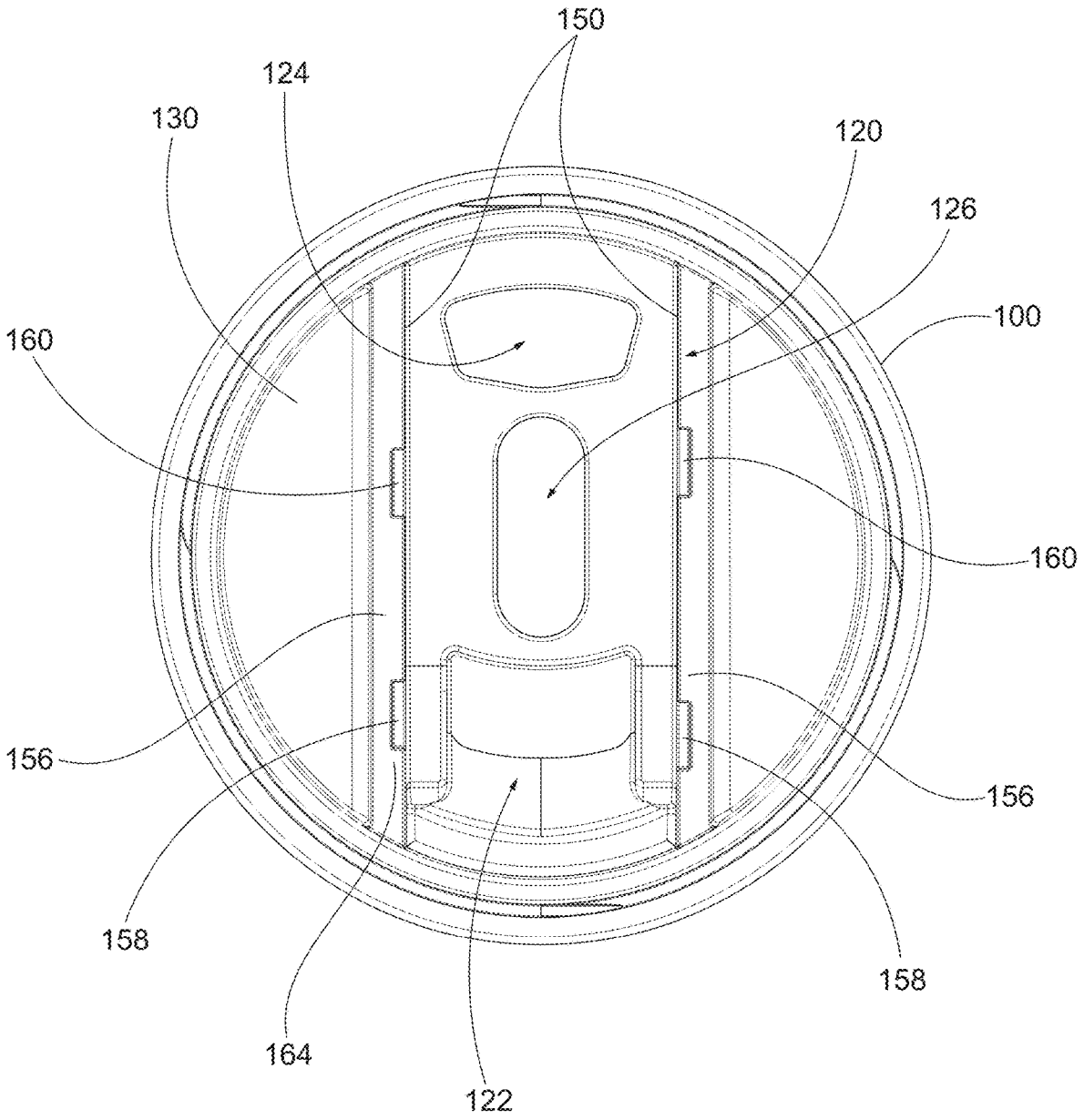
FIG. 15 shows a bottom view of the lid of FIG. 14.
Figure 16:
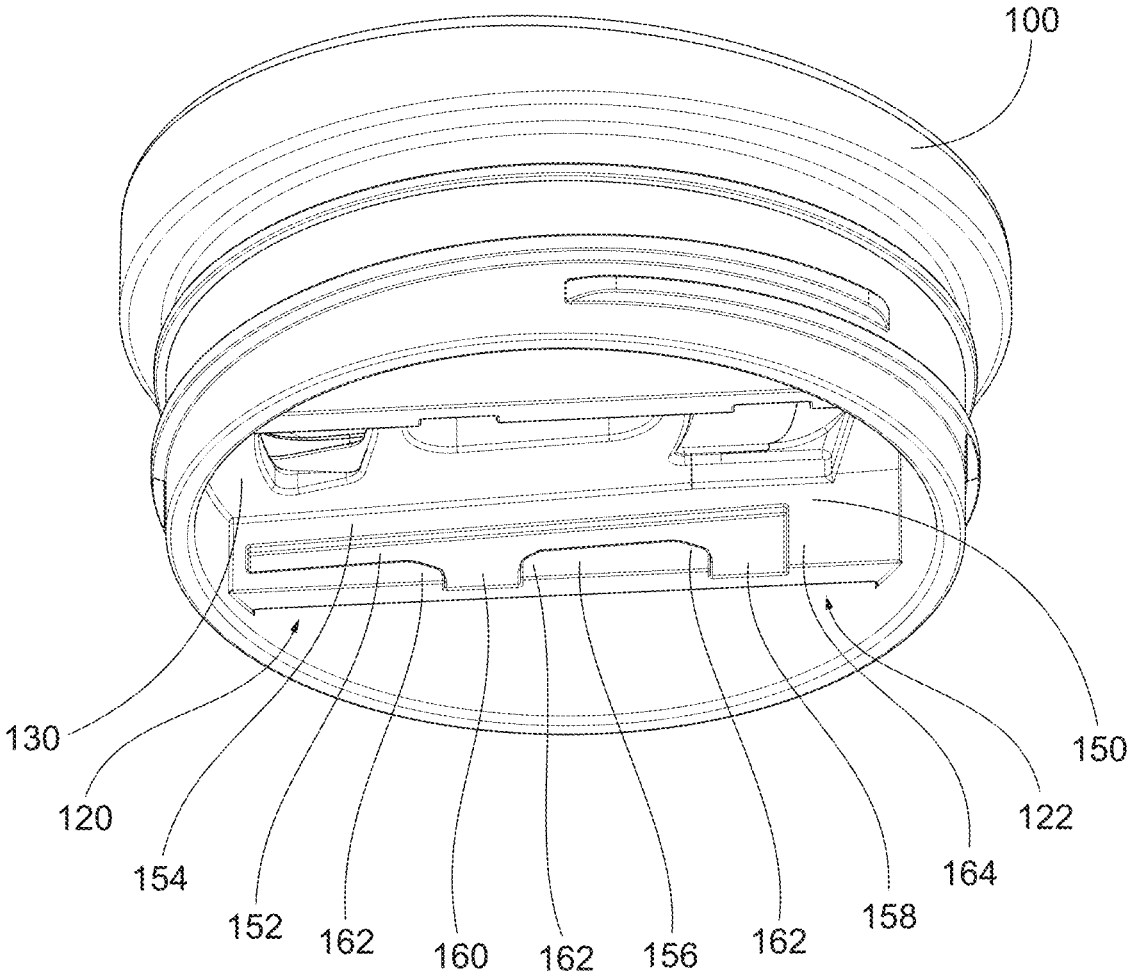
FIG. 16 shows a bottom perspective view of the lid of FIG. 14.

Lid 100 is best shown in FIGS. 14-16, according to an exemplary embodiment. FIG. 14 shows first surface 128. As shown, lid 100 can include a first slider track 140 along first surface 128. First slider track 140 can extend from first end 120 to second end 122 of lid 100 opposing first end 120. First slider track 140 can include at least one projection 142. Projection 142 can extend from a first half 121 (FIG. 14) of lid 100 including first end 120 to a second half 123 (FIG. 14) of lid 100 opposing first half 121, first half 121 and second half 123 being on opposing sides of a centerline A (FIG. 14). Projection 142 can be continuous such that no gaps are formed in projection 142 as projection 142 extends from first half 121 to second half 123. Projection 142 can include a continuous width through a length L, shown in FIG. 14, which is substantially the length of projection 142. Additionally or alternatively, projection can include a continuous width through a height H, shown in FIG. 4, which is substantially the height of projection 142. Referring again to FIGS. 14-16, lid 100 can also include slider opening 126 extending through first surface 128. Slider opening 126 can be disposed within slider track 140, such as between projections 142. Slider opening 126 can be adjacent drink opening 124, which can also extend through first surface 128. Projection 142 can extend continuously along slider opening 126 from first end 120 to second end 122, as shown in FIG. 14.

FIGS. 15-16 shows second surface 130. As shown, lid 100 can include a second slider track 150 along second surface 130. Second slider track 150 can extend from first end 120 to second end 122 of lid 100 opposing first end 120. Second slider track 150 can include an upper receiving detent 152. Upper receiving detent 152 can be bounded by an upper rib 154 and a lower rib 156 of second slider track 150. As shown in FIG. 16, upper receiving detent 152 can be a cavity formed in second slider track 150, with walls of the cavity being upper rib 154 and lower rib 156.

Second slider track 150 can also include one or more lower receiving detents, such as a first pair of lower receiving detents 158 and a second pair of lower receiving detents 160. First pair of lower receiving detents 158 and second pair of lower receiving detents 160 can be formed in lower rib 156. As shown in FIG. 16, first pair of lower receiving detents 158 and second pair of lower receiving detents 160 can be cavities that extend through lower rib 156. First pair of lower receiving detents 158 and second pair of lower receiving detents 160 can be continuous with upper receiving detent 152. Ends of lower rib 156 adjacent first pair of lower receiving detents 158 and second pair of lower receiving detents 160 can include a ramp 162. In addition, a wall 164 can bound ends of upper receiving detent 152 and first pair of lower receiving detents 160.

Each detent in first pair of lower receiving detents 158 can be offset, and each detent in second pair of lower receiving detents 160 can be offset, similar to each projecting tab in first pair of projecting tabs 234 and second pair of projecting tabs 236 discussed above with reference to FIGS. 12-13. Lid 100 can also include slider opening 126 extending through second surface 130. Slider opening 126 can be disposed within slider track 140, such as between projections 142. Slider opening 126 can be adjacent drink opening 124, which can extend through second surface 130.

Figure 17:
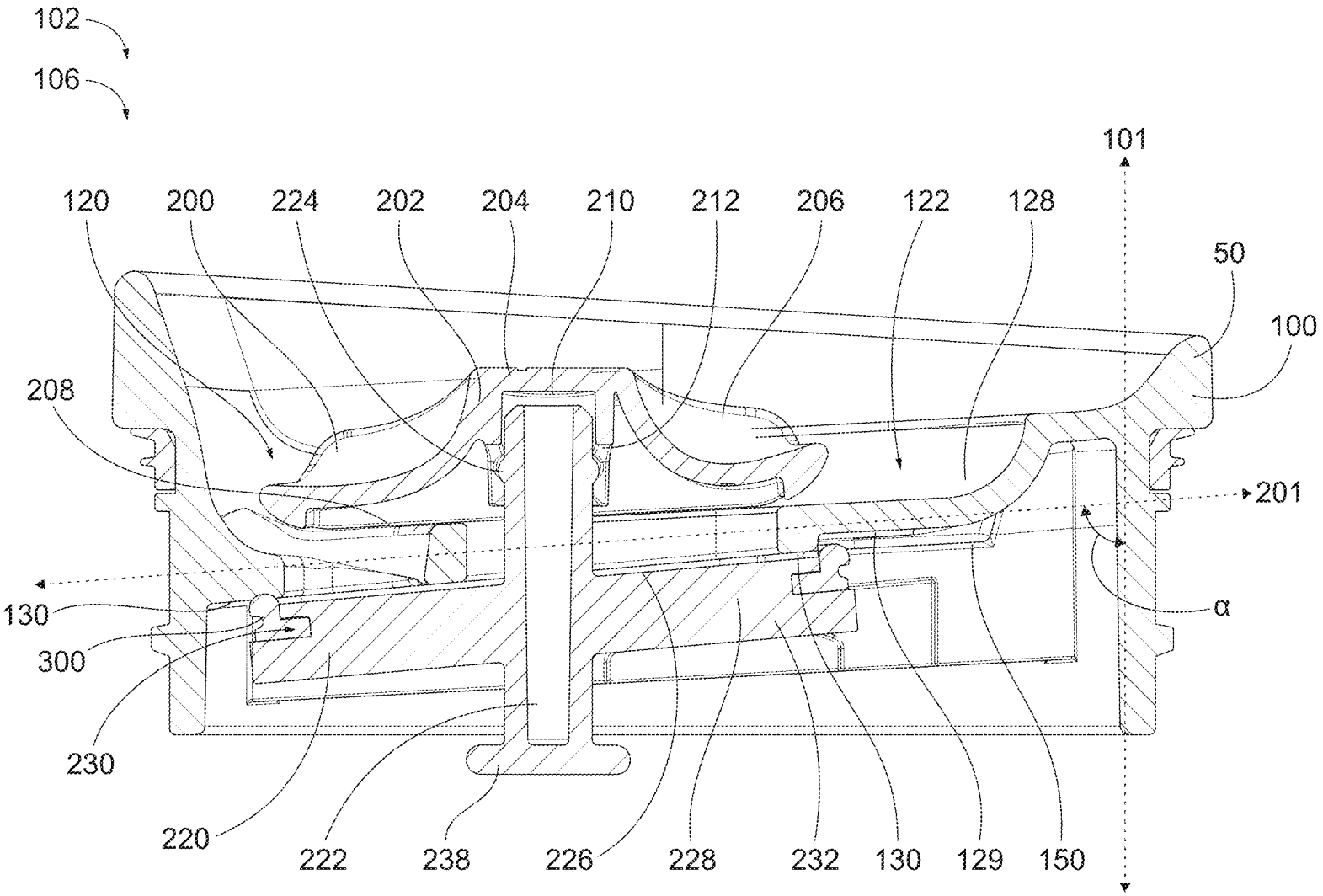
FIG. 17 shows a cross-section view of the lid assembly of FIG. 2 in a closed position along line 17-17.
Figure 19:
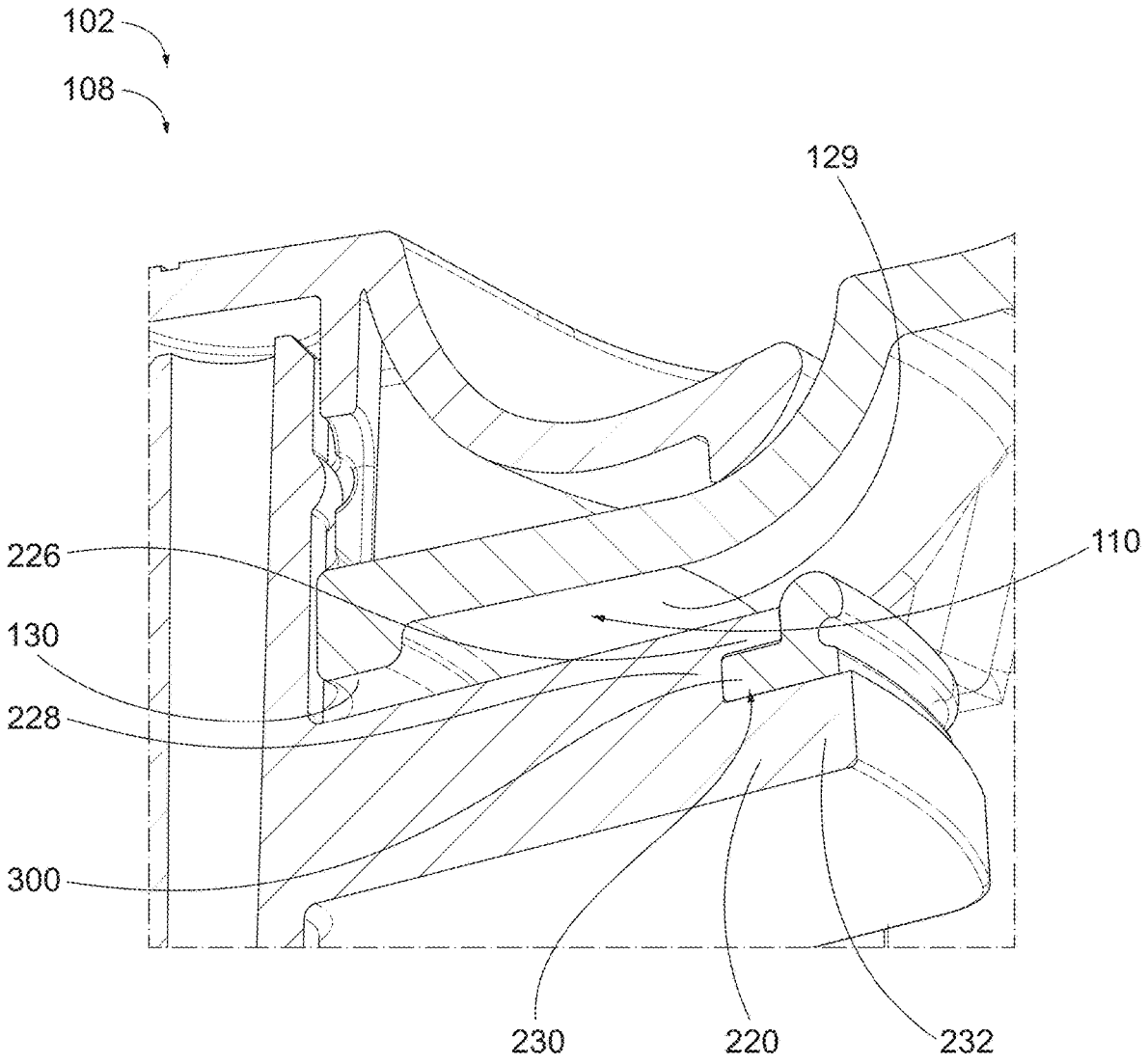
FIG. 19 shows a cross-section view of the lid assembly of FIG. 17 in an open position.

Lid assembly 50 in assembled configuration 102 and closed position 106 is shown in FIG. 17, according to an exemplary embodiment. Lid assembly 50 in assembled configuration 102 and an open position 108 is shown in FIG. 19, according to an exemplary embodiment. Lid 100 and slider 200 can be assembled such that lid 100 is disposed between first slider portion 202 and second slider portion 220, such as between bottom side 208 of first slider portion 202 and upper side 226 of second slider portion 220.

First slider portion 202 and second slider portion 220 can be coupled to assemble slider 200. First slider portion 202 can include a receiving portion 210, and second slider portion 220 can include a projecting portion 222 to removably couple to receiving portion 210. Projecting portion 222 can include a rib 224 that can be retained by receiving portion 210 in an assembled configuration of slider 200. Rib 224 can be retained via a snap fit by receiving portion 210. Receiving portion 210 can include groove or opening 212 that can retain rib 224. Lid 100 can include slider opening 126 (FIG. 15) through which projecting portion 220 can extend through to couple to receiving portion 210. Slider 200 can slide along lid 100 between first end 120 and second end 122 to selectively reveal drink opening 124 positioned at first end 120 of lid 100, with projecting portion 222 sliding through slider opening 126.

Slider 200 can be disassembled when drink opening 124 is fully revealed. In other words, slider 200 can be disassembled at second end 122 when slider 200 is away from drink opening 124 positioned at first end 120. As shown with reference to FIGS. 17 and 19, pull tab 238 can release slider 200 from an assembled configuration of slider 200 when slider 200 is at second end 122. To release second slider portion 220 from first slider portion 202, the snap fit between rib 224 and receiving portion 210, such as groove or opening 212, can be overcome.

First slider portion 202 can slide along first slider track 140, which can extend along first surface 128 of lid 100. First slider portion 202 can couple to one or more projections 142 (FIG. 4) to slide along first slider track 140. Second slider portion 220 can slide along second slider track 150, which can extend along second surface 130 of lid 100. Sliding of second slider portion 220 along second slider track 150 can be stopped by wall 164 (FIG. 16).

Slider 200 can slide along first slider track 140 and second slider track 150 to selectively reveal drink opening 124. Slider 200 can couple to first slider track 140 and second slider track 150. First slider track 140 can include at least one projection 142, and slider 200, such as first slider portion 202, can include at least one retention portion 214 to receive at least one projection 142. Second slider track 150 can include a receiving detent, such as upper receiving detent 152 (FIG. 16), to receive at least one projecting tab, such as first pair of projecting tabs 234 (FIG. 13) and second pair of projecting tabs 236 (FIG. 13), of slider 200, such as of second slider portion 220. Upper receiving detent 152 can receive second slider portion 220, such as first pair of projecting tabs 234 and second pair of projecting tabs 236 of second slider portion 220, in a first position shown in FIG. 17, in which drink opening 124 is closed and in a second position, in which drink opening 124 is at least partially revealed. Second slider track 150 can include additional receiving detents, such as first pair of lower receiving detents 158 (FIG. 16) and second pair of lower receiving detents 160 (FIG. 16).

As discussed above, upper receiving detent 152 can be bounded by upper rib 154 and lower rib 156. First pair of lower receiving detents 158 and second pair of lower receiving detents 160 can extend through lower rib 156 such that slider 200 is movable between an assembled configuration shown in FIG. 17 and a disassembled configuration shown in FIG. 19. In a third position shown in FIG. 19 in which drink opening 124 is fully revealed, first pair of lower receiving detents 158 (FIG. 16) can receive at least one projecting tab, such as first pair of projecting tabs 234 (FIG. 13). Also in the third position, second pair of lower receiving detents 160 (FIG. 16) can receive at least one projecting tab, such as second pair of projecting tabs 236 (FIG. 13). In the third position, first pair of projecting tabs 234 and second pair of projecting tabs 236 can move through first pair of lower receiving detents 158 and second pair of lower receiving detents 160, respectively, such that second slider portion 220 can withdraw from second slider track 150. In this way, second slider portion 220 and first slider portion 202 can be released and slider 200 can be moved to a disassembled configuration.

Portions of lid 100 can be slanted, as best shown in FIG. 17. Portions of lid 100, such as first surface 128, intermediate surface 129, and second surface 130, can extend along axes approximately parallel to axis 201. Accordingly, slider 200 can extend along an axis approximately parallel to axis 201. For example, first slider portion 202, such as bottom side 208, can extend along an axis approximately parallel to axis 201, as first slider portion can slide along lid 100. In addition, second slider portion 220, such as upper side 226 can extend along an axis approximately parallel to axis 201, as second slider portion 220 can slide along lid 100. Gasket 300, which can seal against lid 100, such as second surface 130, can also extend along an axis approximately parallel to axis 201. As shown, projecting portion 222 and pull tab 238 of second slider portion 220 can extend along an axis approximately parallel to an axis 101. Axis 101 can be a longitudinal axis of lid 100. Axis 201 can be at an angle $\alpha$ from axis 101, where angle $\alpha$ is an acute angle between about five degrees and about 80 degrees, such as between about 10 degrees and about 75 degrees, such as between about 30 degrees and about 60 degrees. In this way, portions of lid 100 can be slanted by extending along axes approximately parallel to axis 201. In other exemplary embodiments, lid 100 can be substantially flat. In other words, lid 100 can be substantially parallel to a flat surface on which drink container 10 (FIG. 1) rests. Angle $\alpha$ in these exemplary embodiments can be about 90 degrees.

Figure 18:
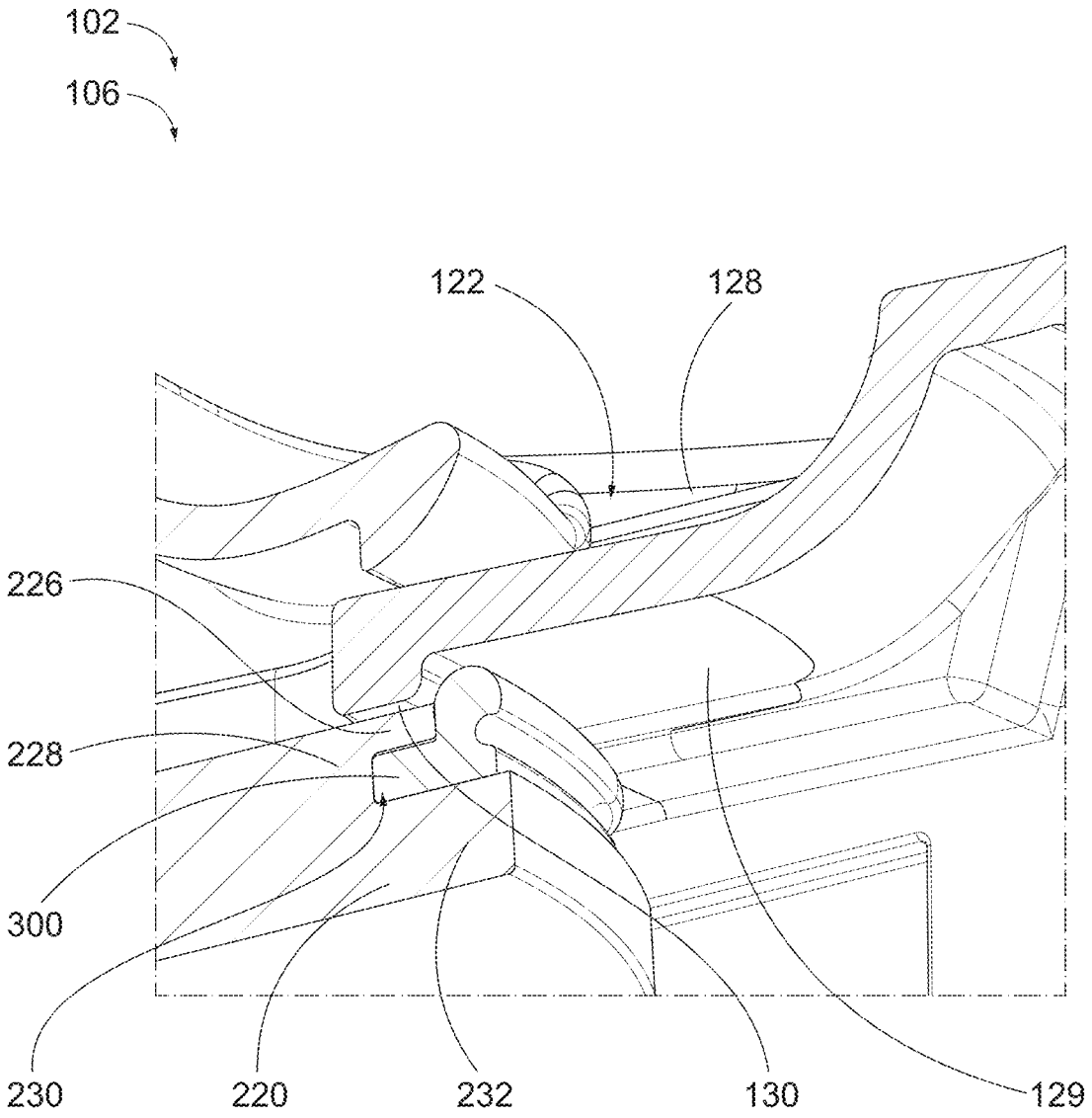
FIG. 18 shows an enlarged view of the cross-section view of the lid of FIG. 17.

Drink container 10 (FIG. 1) described herein can also facilitate venting. Referring to FIGS. 17-18, gasket 300 can be disposed between lid 100 and slider 200, such as between lid 100 and second slider portion 220, such as between second surface 130 of lid 100 and upper side 226 of second slider portion 220. Gasket 300 can also be inserted into gap 230 formed by intermediate side 228 of second slider portion 220. According to an exemplary embodiment, gasket 300 can be sealed against second surface 130. Slider 200 can move from first end 120 to second end 122 of lid 100 opposing first end 120 to selectively reveal drink opening 124. Gasket 300 can facilitate venting away from drink opening 124 as slider 200 moves from first end 120 to second end 122. Gasket 300 can be sealed against second surface 130 along first end 120 of lid 100 as slider 200 is at first end 120 to prevent venting. Gasket 300 can be sealed against second surface 130 along first end 120 of lid 100 as slider 200 moves from first end 120 to second end 122 to prevent venting (FIGS. 17-18). Gasket 300 can be sealed against second surface 130 such that gasket 300 is in contact with second surface 130. And gasket 300 can be released from second surface 130 along second end 122 of lid 100 when slider 200 is at second end 122 to facilitate venting (FIG. 19). Gasket 300 can be released from second surface 130 such that gasket 300 is not in contact with second surface 130.

Lid 100 can include second surface 130, which can be a lower surface to contact gasket 300 along first end 120 and as slider moves from first end 120 to second end 122. Lid 100 can also include an intermediate surface 129 above second surface 130 at second end 122 such that a gap portion 110 forms between intermediate surface 129 and gasket 300 to release gasket 300 from lid 100 at second end 122. Lid 100 can include gap portion 110 such that a venting space is formed between lid 100 and gasket 300 when slider 200 is at second end 122. Intermediate surface 129 being above second surface 130 can allow a space, or gap portion 110, to be formed between gasket 300 and lid 100 when slider 200 is at second end 122, as shown in FIG. 19. Slider 200 can move again from second end 122 to first end 120 such that gasket 300 is sealed against second surface 130 to prevent venting.

Venting can allow release of steam from drink container 10 (FIG. 1) through one or more openings to ambient, such as slider opening 126, which can be revealed when slider 200 is at second end 122 and gasket 300 is released from second surface 130. In this way, venting can occur away from drink opening 124 (FIG. 4)

Figure 20:
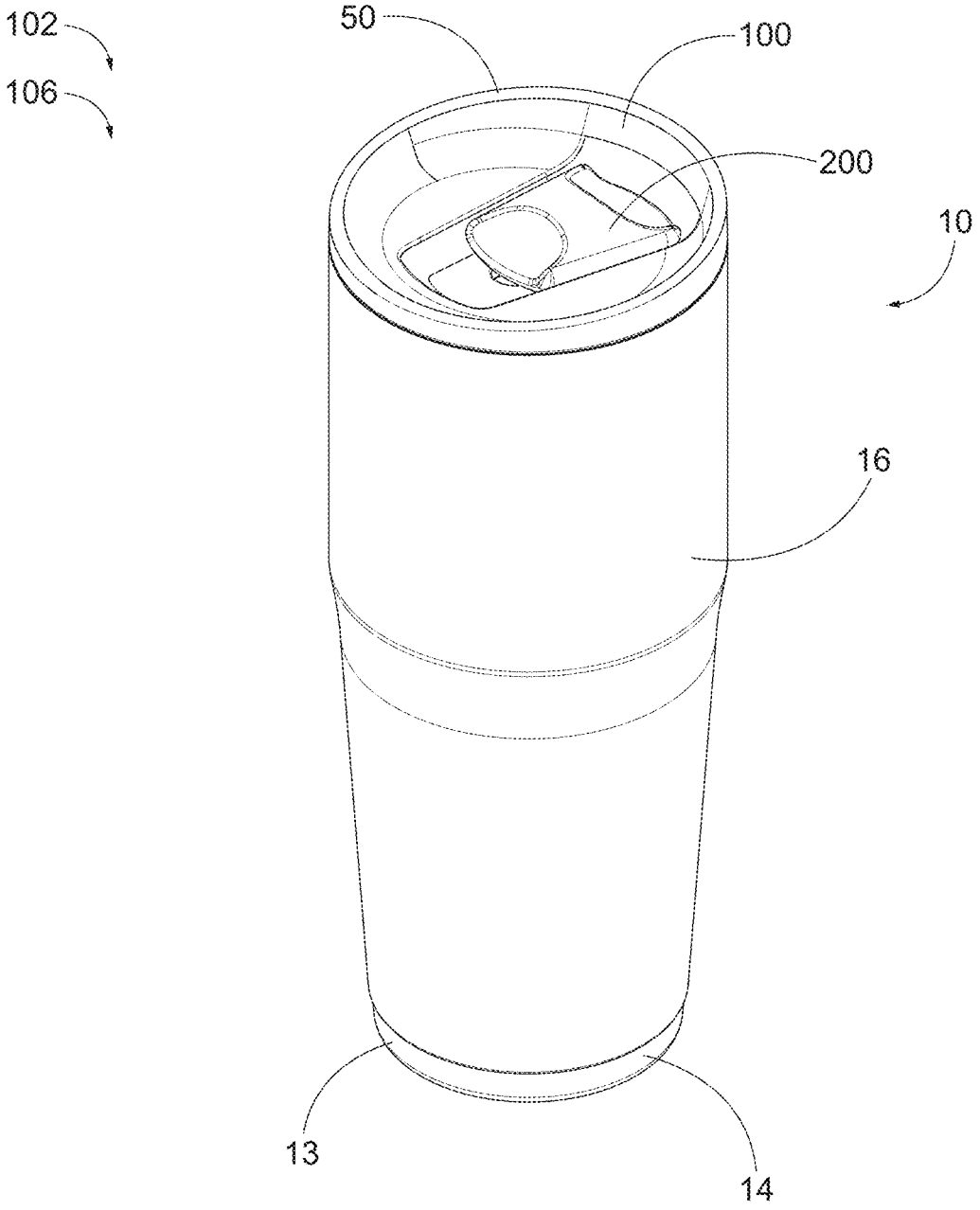
FIG. 20 shows a perspective view of a drink container according to an exemplary embodiment.

Drink container 10 is shown in FIGS. 20-24, according to exemplary embodiments. As discussed herein, drink container 10 can hold both cold and hot beverages in liquid container 16. Drink container 10 can include liquid container 16 and a lid 100. Liquid container 16 can include a base 13. Base 13 can extend from liquid container 16 and can be received by liquid container 16. Drink opening 124 of lid 100 can be a through opening extending from lid 100 to base 13. As shown in FIG. 20, drink container 10 can include a taper, similar to drink container in FIG. 1. Drink container 10 can taper towards base 13.

Figure 21:
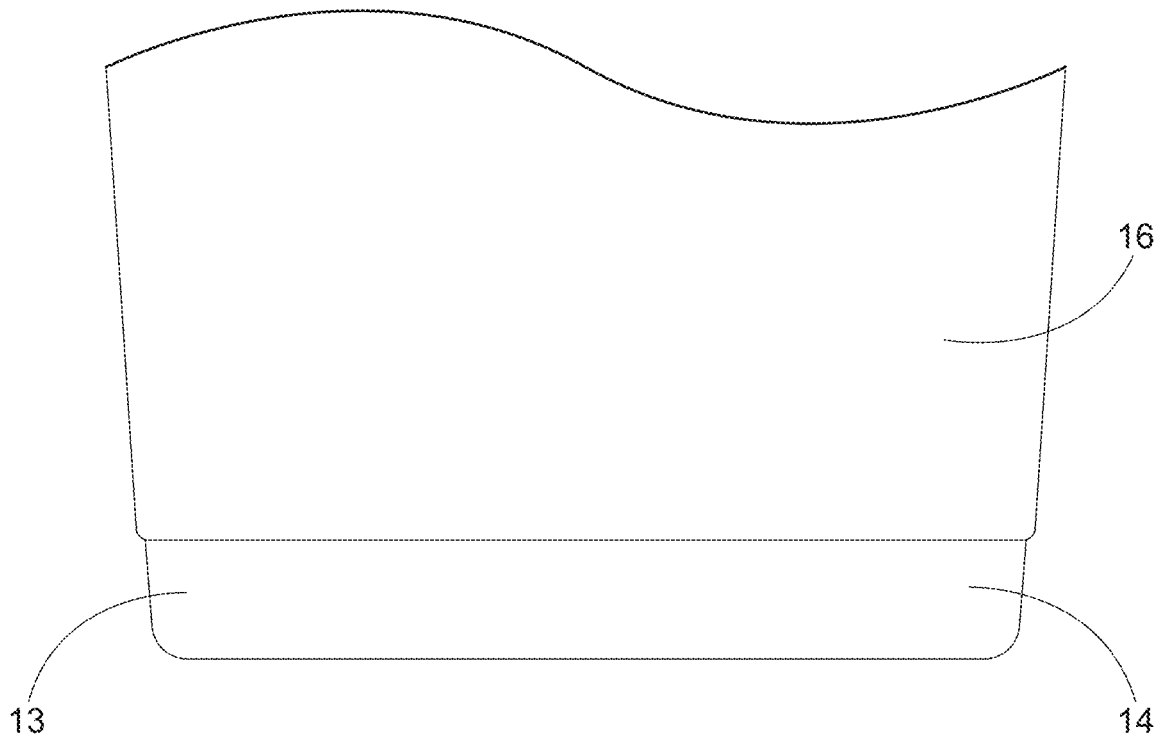
FIG. 21 shows an enlarged front view of the drink container of FIG. 20.
Figure 22:
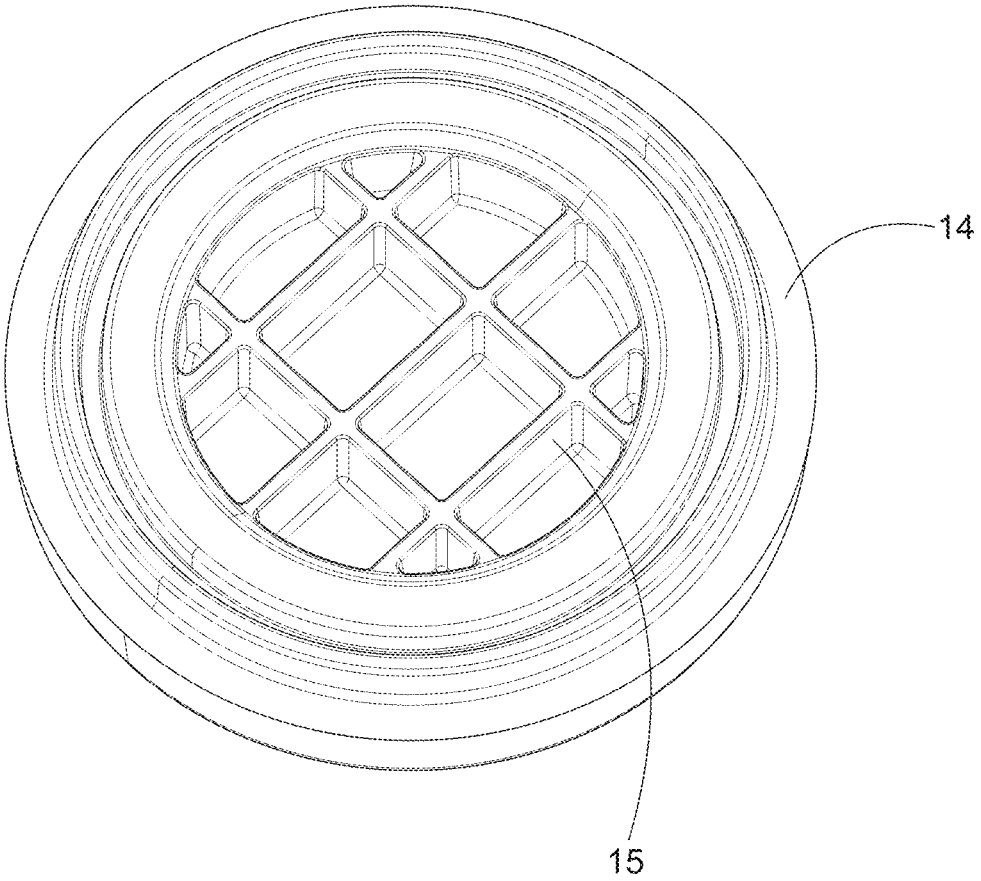
FIG. 22 shows a perspective view of a damper of the drink container of FIG. 21.
Figure 23:
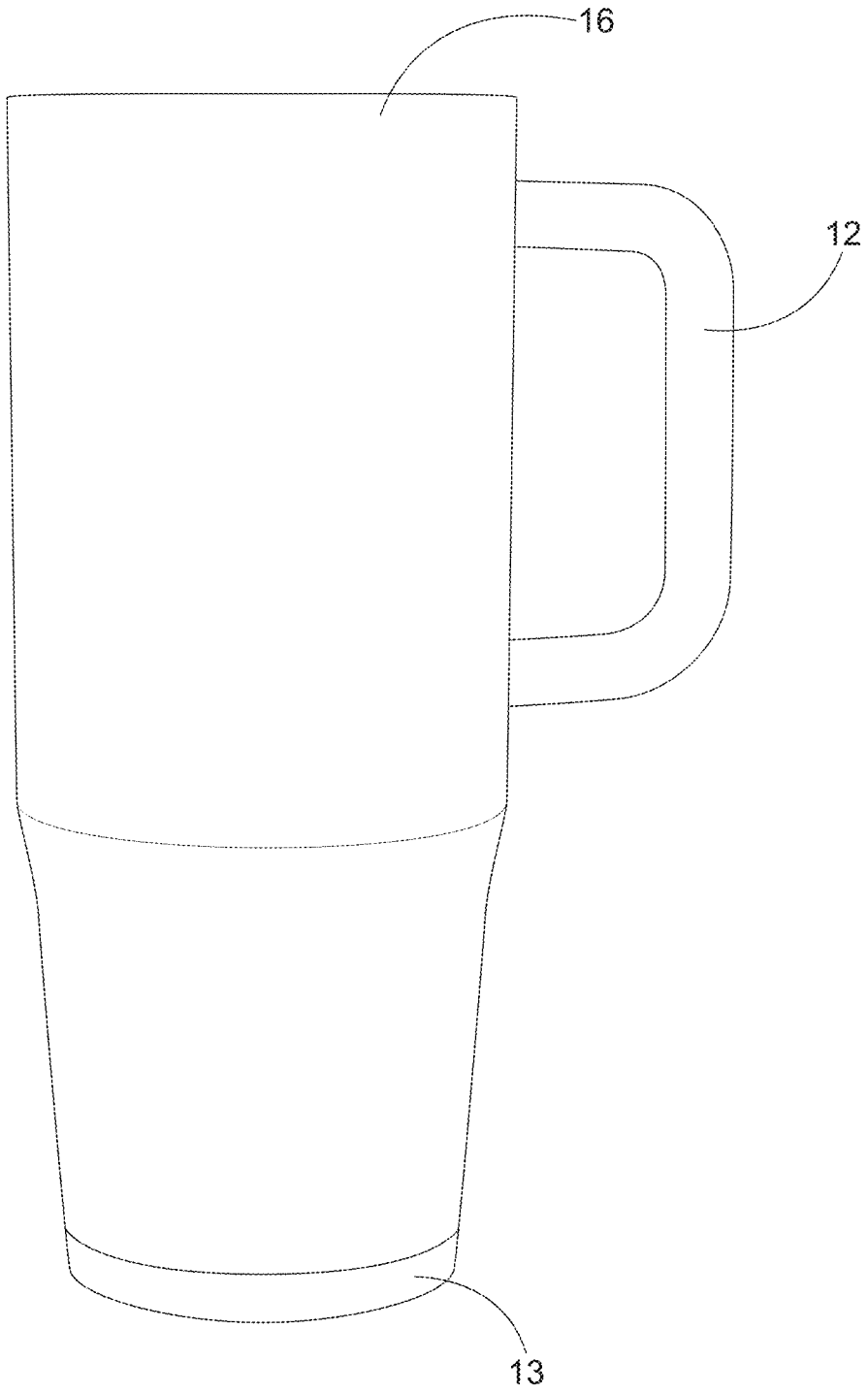
FIG. 23 shows a front view of a drink container according to an exemplary embodiment.
Figure 24:
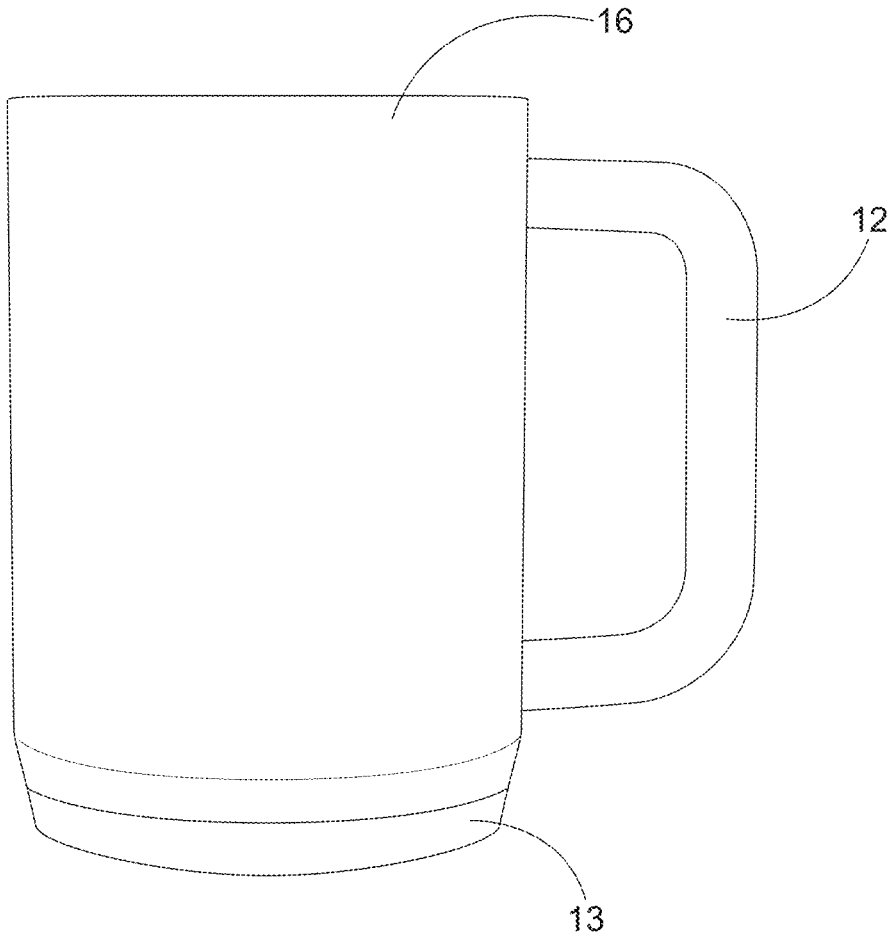
FIG. 24 shows a front view of a drink container according to an exemplary embodiment.

Base 13 can include a damper 14, shown in FIG. 21. Damper 14 can include a rubber material. Damper 14 can include a grid structure 15, show in FIG. 22. Damper 14 having grid structure 15 can cushion liquid container 16. Grid structure 15 can include one or more shapes, such as rectangular, circular, or honeycombed shapes. In this way, grid structure 15 can absorb impact, such as from placing drink container 10 on a surface or from transporting or storing drink container 10. Other exemplary embodiments of drink container 10 described herein are shown in FIGS. 23-24. As shown, drink container 10 can be taller or shorter. In addition, drink container 10 can include a handle 12.

It should be noted that the use of particular terminology when describing certain features or exemplary embodiments of the disclosure should not be taken to imply that the terminology is being re-defined herein to be restricted to include any specific characteristics of the features or exemplary embodiments of the disclosure with which that terminology is associated. Terms and phrases used in this application, and variations thereof, especially in the appended claims, unless otherwise expressly stated, should be construed as open-ended as opposed to limiting. As examples of the foregoing, the term "including" should be read to mean "including, without limitation," "including but not limited to," or the like; the term "comprising" as used herein is synonymous with "including," "containing," or "characterized by," and is inclusive or open-ended and does not exclude additional, unrecited elements or method steps; the term "having" should be interpreted as "having at least"; the term "such as" should be interpreted as "such as, without limitation"; the term "includes" should be interpreted as "includes but is not limited to"; the term "example" is used to provide exemplary instances of the item in discussion, not an exhaustive or limiting list thereof, and should be interpreted as "example, but without limitation"; adjectives such as "known," "normal," "standard," and terms of similar meaning should not be construed as limiting the item described to a given time period or to an item available as of a given time, but instead should be read to encompass known, normal, or standard technologies that can be available or known now or at any time in the future; and use of terms like "preferably," "preferred," "desired," or "desirable," and words of similar meaning should not be understood as implying that certain features are critical, essential, or even important to the structure or function of the present disclosure, but instead as merely intended to highlight alternative or additional features that can or cannot be utilized in an exemplary embodiment.

Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. The terms "about" or "approximate" and the like are synonymous and are used to indicate that the value modified by the term has an understood range associated with it, where the range can be ±20%, ±15%, ±10%, ±5%, or ±1%. The term "substantially" is used to indicate that a result (e.g., measurement value) is close to a targeted value, where close can mean, for example, the result is within 80% of the value, within 90% of the value, within 95% of the value, or within 99% of the value. Also, as used herein "defined" or "determined" can include "predefined" or "predetermined" and/or otherwise determined values, conditions, thresholds, measurements, and the like.

What is claimed is:

1. A lid assembly for a drink container, comprising:

a lid comprising an opening through which a liquid is selectively dispensed, the opening positioned at a first end of the lid;

a first slider track along a first surface of the lid, the first slider track comprising a projection configured to extend from a first half of the lid including the first end to a second half of the lid opposite the first half, the projection comprising a continuous width through its length and height; and a slider configured to selectively reveal the opening, the slider comprising:

a top slider portion configured to couple to the projection to slide along the first slider track, the top slider portion comprising a receiving portion; and a bottom slider portion comprising a projecting portion configured to removably couple to the receiving portion, wherein projecting portion is received by the receiving portion in an assembled configuration, and wherein the projecting portion comprises a rib configured to be retained via a snap fit by the receiving portion in the assembled configuration.

2. The lid assembly of claim 1, wherein the lid further comprises a slider opening, the projecting portion configured to extend through the slider opening to couple to the receiving portion.

3. A lid assembly for a drink container, comprising:

a lid comprising an opening through which a liquid is selectively dispensed, the opening positioned at a first end of the lid;

a first slider track along a first surface of the lid, the first slider track comprising a projection configured to extend from a first half of the lid including the first end to a second half of the lid opposite the first half, the projection comprising a continuous width through its length and height; and a slider configured to selectively reveal the opening, the slider comprising:

a top slider portion configured to couple to the projection to slide along the first slider track, the top slider portion comprising a receiving portion; and a bottom slider portion comprising a projecting portion configured to removably couple to the receiving portion, wherein projecting portion is received by the receiving portion in an assembled configuration, and wherein the bottom slider portion comprises a tab opposing the projecting portion, the tab configured to release the slider from the assembled configuration.

4. A lid assembly for a drink Container, comprising:

a lid comprising an opening through which a liquid is selectively dispensed, the opening positioned at a first end of the lid;

a first slider track along a first surface of the lid, the first slider track comprising a projection configured to extend from a first half of the lid including the first end to a second half of the lid opposite the first half, the projection comprising a continuous width through its length and height;

a second slider track extending along a second surface of the lid opposing the first surface from the first end of the lid to a second end of the lid opposing the first end, wherein the second slider track comprises an upper receiving detent configured to receive the bottom slider portion in a first position in which the opening is closed and a second position in which the opening at least partially is revealed; and a slider configured to selectively reveal the opening, the slider comprising:

a top slider portion configured to couple to the projection to slide along the first slider track, the top slider portion comprising a receiving portion; and a bottom slider portion comprising a projecting portion configured to removably couple to the receiving portion.

5. The lid assembly of claim 4, wherein the second slider track comprises a first pair of lower receiving detents extending from the upper receiving detent, the first pair of lower receiving detents configured to receive a first pair of projecting tabs of the bottom slider portion in a third position in which the opening is fully revealed and the slider is movable between an assembled configuration and a disassembled configuration.

6. The lid assembly of claim 5, wherein the second slider track comprises a second pair of lower receiving detents extending from the upper receiving detent, the second pair of lower receiving detents configured to receive a second pair of projecting tabs of the bottom slider portion in the third position in which the opening is fully revealed and the slider is movable between the assembled configuration and the disassembled configuration.

7. The lid assembly of claim 5, wherein the upper receiving detent is bounded by an upper rib and a lower rib opposing the upper rib to form the second slider track, the first pair of lower receiving detents extending through the lower rib such that the slider is movable between the assembled configuration and the disassembled configuration.

8. A lid assembly for a drink container, comprising: a lid comprising:

an opening through which a liquid is selectively dispensed, the opening extending through a first surface of the lid to a second surface of the lid opposing the first surface, wherein the opening is positioned at a first end of the lid, a first slider track along the first surface of the lid, the first slider track comprising at least one projection, and a second slider track along the second surface of the lid, the second slider track comprising at least one receiving detent;

a slider configured to slide along the first slider track and the second slider track from the first end to a second end of the lid opposing the first end to selectively reveal the opening, the slider comprising: at least one retention portion configured to receive the at least one projection, and at least one projecting tab, the at least one receiving detent configured to receive the at least one projecting tab; and a gasket disposed between the lid and the slider along the second surface of the lid, wherein the gasket is sealed against the second surface along the first end of the lid as the slider moves from the first end to the second end to prevent venting, wherein the gasket is released from the second surface along the second end of the lid when the slider is at the second end to facilitate venting.

9. The lid assembly of claim 8, wherein the slider further comprises a first slider portion and a second slider portion, the first slider portion comprising the retention portion, and the second slider portion comprising the at least one projecting tab, and wherein the second slider portion is removable from the first slider portion when the opening is fully revealed.

10. The lid assembly of claim 8, wherein the lid comprises a gap portion such that a venting space is formed between the lid and the gasket when the slider is at the second end.

* * * * *